US009845579B2

(12) United States Patent
Pembleton et al.

(10) Patent No.: US 9,845,579 B2
(45) Date of Patent: Dec. 19, 2017

(54) PAVEMENT COATING SYSTEM HAVING SHIFTABLE SPRAY BAR

(71) Applicant: Bergkamp, Inc., Salina, KS (US)

(72) Inventors: Joesph Pembleton, Salina, KS (US); Maynard Cunningham, Ellsworth, KS (US); Jason Bergkamp, Mount Hope, KS (US)

(73) Assignee: Bergkamp, Inc., Salina, KS (US)

( * ) Notice: Subject to any disclaimer, the term of this patent is extended or adjusted under 35 U.S.C. 154(b) by 78 days.

(21) Appl. No.: 15/008,151

(22) Filed: Jan. 27, 2016

(65) Prior Publication Data

US 2016/0215460 A1 Jul. 28, 2016

Related U.S. Application Data

(60) Provisional application No. 62/108,273, filed on Jan. 27, 2015.

(51) Int. Cl.

| | |
|---|---|
| ***E01C 19/00*** | (2006.01) |
| ***E01C 19/17*** | (2006.01) |
| ***E01C 7/00*** | (2006.01) |
| ***E01C 11/24*** | (2006.01) |
| ***E01C 23/00*** | (2006.01) |
| ***B05B 1/20*** | (2006.01) |

(52) U.S. Cl.

CPC ..... *E01C 19/176* (2013.01); *B05B 1/20* (2013.01); *E01C 7/00* (2013.01); *E01C 11/24* (2013.01); *E01C 19/174* (2013.01); *E01C 19/178* (2013.01); *E01C 23/00* (2013.01)

(58) Field of Classification Search

CPC ..... E01C 7/00; E01C 19/174; E01C 19/176; E01C 19/178; E01C 11/24; E01C 23/00; B05B 1/20

USPC ..... 404/84.05, 101–107, 111

See application file for complete search history.

(56) References Cited

U.S. PATENT DOCUMENTS

| | | | | |
|---|---|---|---|---|
| 2,046,373 | A | 7/1936 | Etnyre | |
| 4,817,870 | A | 4/1989 | Dalton | |
| 5,324,136 | A | 6/1994 | Reymonet et al. | |
| 5,522,543 | A * | 6/1996 | Herzog | B60P 3/224 137/527.8 |
| 5,957,621 | A * | 9/1999 | Clark, Jr. | E01C 19/174 239/159 |
| 5,964,410 | A * | 10/1999 | Brown | A01M 7/0014 137/513.3 |
| 6,776,557 | B2 | 8/2004 | Bamat et al. | |
| 2002/0190138 | A1* | 12/2002 | Terry | E01C 7/185 239/172 |
| 2015/0337501 | A1* | 11/2015 | Thieme | E01C 11/24 404/75 |

FOREIGN PATENT DOCUMENTS

| | | | | |
|---|---|---|---|---|
| FR | 2659993 | * | 9/1991 | E01C 19/17 |

OTHER PUBLICATIONS

Etnyre, Black-Topper® Centennial Asphalt Distributor, Manual No. M-114-07R (document dated Jul. 2009).

* cited by examiner

*Primary Examiner* — Raymond W Addie

(74) *Attorney, Agent, or Firm* — Hovey Williams LLP

(57) ABSTRACT

A coating applicator vehicle is configured to selectively discharge a flow of liquid emulsion and aggregate onto a roadway. The vehicle includes a rolling chassis and a powered spraying assembly supported by the chassis. The spraying assembly includes a spray bar assembly including a shiftable spray boom and a plurality of spray nozzles.

40 Claims, 17 Drawing Sheets

PAVEMENT COATING SYSTEM HAVING SHIFTABLE SPRAY BAR

RELATED APPLICATION

This application claims the benefit of U.S. Provisional Application Ser. No. 62/108,273, filed Jan. 27, 2015, entitled PAVEMENT COATING SYSTEM, which is hereby incorporated in its entirety by reference herein.

BACKGROUND

1. Field

The present invention relates generally to road paving equipment. More specifically, embodiments of the present invention concern a pavement coating system configured to spray a mastic material to a road.

2. Discussion of Prior Art

Paving construction and repair vehicles have long been used to dispense one or more types of flowable pavement coating materials onto an existing roadway. For instance, conventional paving vehicles are well known for laying, spreading, and screeding a layer of bituminous asphalt onto a roadway. Other conventional vehicles comprise a distributing vehicle that is configured to spray a liquified tack coat material onto an existing asphalt road surface.

Yet further, other known vehicles are configured to spray a friction mastic material that includes a liquid asphalt emulsion, aggregate, and one or more polymers. The mastic mixture is generally sprayed onto the surface of a paved road to extend the usable life of the road.

However, conventional paving construction and repair vehicles have various deficiencies. For instance, conventional vehicles that spray friction mastic material are difficult and expensive to use. For example, these conventional vehicles generally carry a large volume of mastic material that must be strained during the spraying process to separate aggregate particles and congealed clumps of material from the mastic to be sprayed and to store the separated particles and clumps in a straining basket. The process of removing the separated particles and clumps from the vehicle is notoriously time consuming and requires the use heavy machinery to lift and move the basket and material from the vehicle.

Another deficiency associated with conventional distributing vehicles is that sprayed material is easily wasted because of the difficulty associated with positioning and advancing the vehicle. For instance, the spray boom of prior art distributing vehicles is difficult to align precisely with the side margin of the roadway.

SUMMARY

The following brief summary is provided to indicate the nature of the subject matter disclosed herein. While certain aspects of the present invention are described below, the summary is not intended to limit the scope of the present invention.

Embodiments of the present invention provide a pavement coating system that does not suffer from the problems and limitations of the prior art material distributing vehicles set forth above.

A first aspect of the present invention concerns a coating applicator vehicle configured to selectively discharge a flowable pavement coating material onto a roadway. The coating applicator vehicle broadly includes a rolling chassis and a spray bar assembly. The rolling chassis is operable to be advanced in a forward direction along the roadway. The spray bar assembly is supported by the rolling chassis and extends transversely to the forward direction to selectively discharge coating material along a lateral direction. The spray bar assembly includes a shiftable spray boom, spray nozzles, and a frame mounted relative to the chassis. The spray boom presents an elongated chamber to receive and carry the coating material laterally. The spray nozzles fluidly communicate with the chamber to receive a flow of the coating material from the spray boom and discharge the coating material. The spray boom is shiftably supported by the frame to move laterally relative to the rolling chassis.

A second aspect of the present invention concerns a spray bar assembly operable to be mounted on and advanced in a forward direction with a vehicle to discharge flowable pavement coating material onto a roadway, where the material includes a liquid emulsion and aggregate. The spray bar assembly broadly includes a shiftable spray boom and a plurality of spray nozzles. The spray boom presents an elongated chamber to receive and carry the coating material laterally. The spray nozzles fluidly communicate with the chamber to receive a flow of coating material from the spray boom and to discharge the flow of coating material. The spray nozzles are mounted relative to the spray boom and spaced along a lateral line that extends along the length of the spray boom, with each pair of adjacent spray nozzles being separated by a spacing dimension. Each of the spray nozzles discharges the coating material in a generally planar fan pattern that impinges the roadway along a laterally extending spray line. The line defines a maximum fan width dimension greater than the spacing dimension. The spray nozzles are positioned so that the spray line associated with each spray nozzle extends at an acute angle relative to the lateral direction, with the fan patterns of adjacent spray nozzles overlapping one another without intersecting.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Preferred embodiments of the invention are described in detail below with reference to the attached drawing figures, wherein.

Figures 7A, 7B:
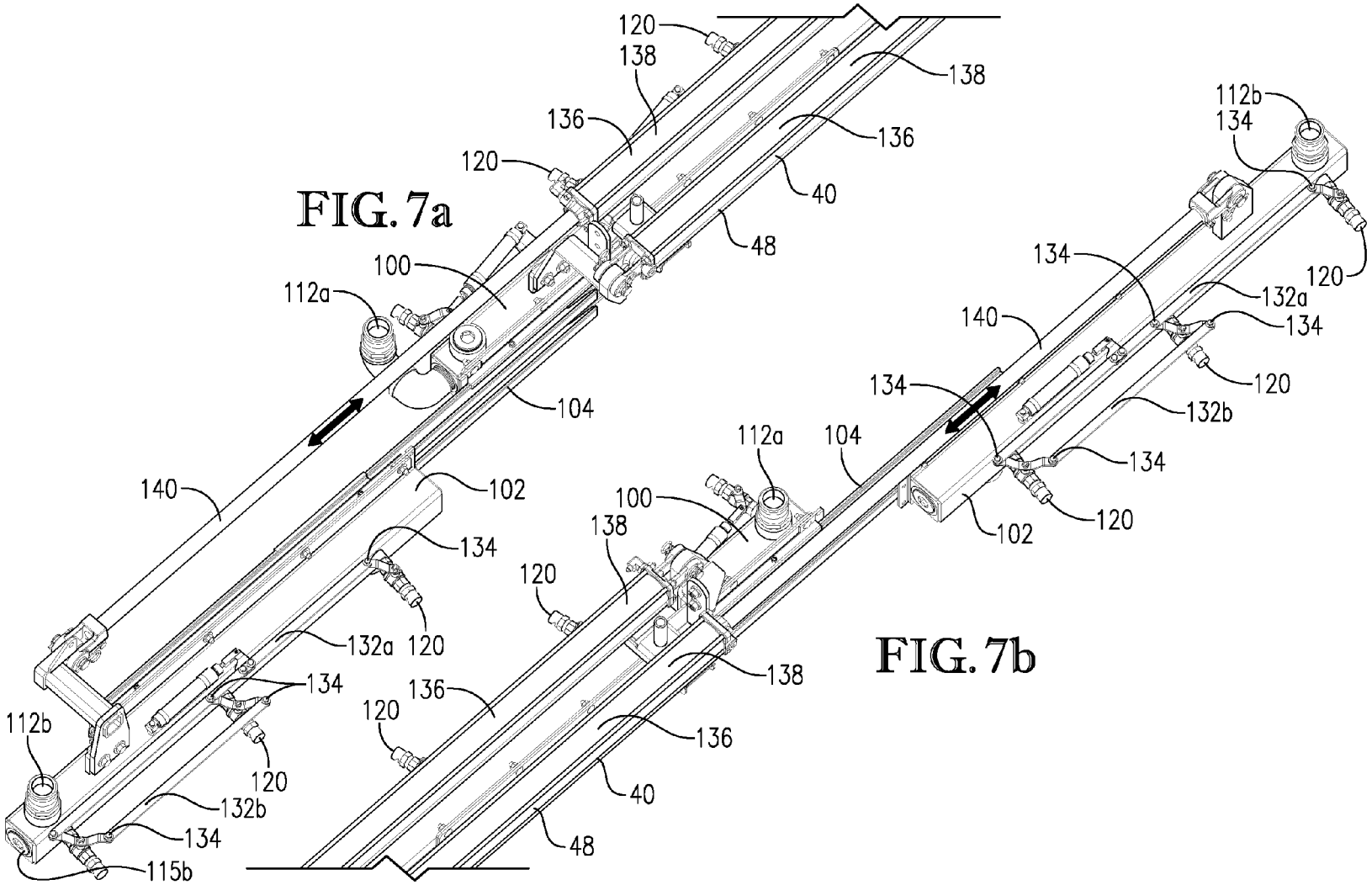
Figure 8:
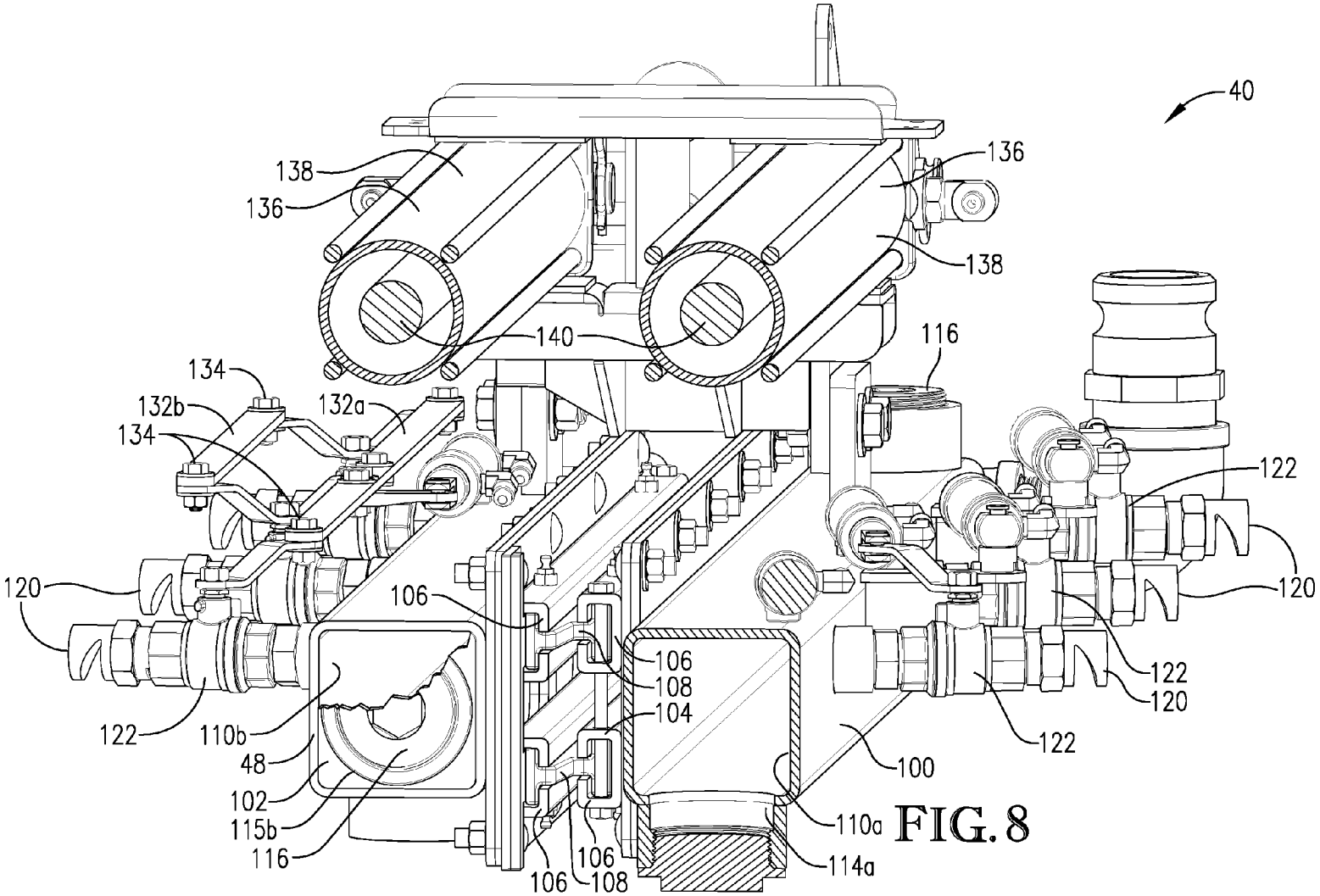

FIG. 7*a* is a fragmentary upper perspective of the spray bar assembly shown in FIGS. 1-6, showing the extendable boom section on the right side of the vehicle shifted laterally outboard to an extended position;

FIG. 7*b* is a fragmentary upper perspective of the spray bar assembly shown in FIGS. 1-7*a*, showing the extendable boom section on the left side of the vehicle shifted laterally outboard to an extended position;

FIG. 8 is a fragmentary cross section of the spray bar assembly shown in FIGS. 1-7*b;*

Figure 1:
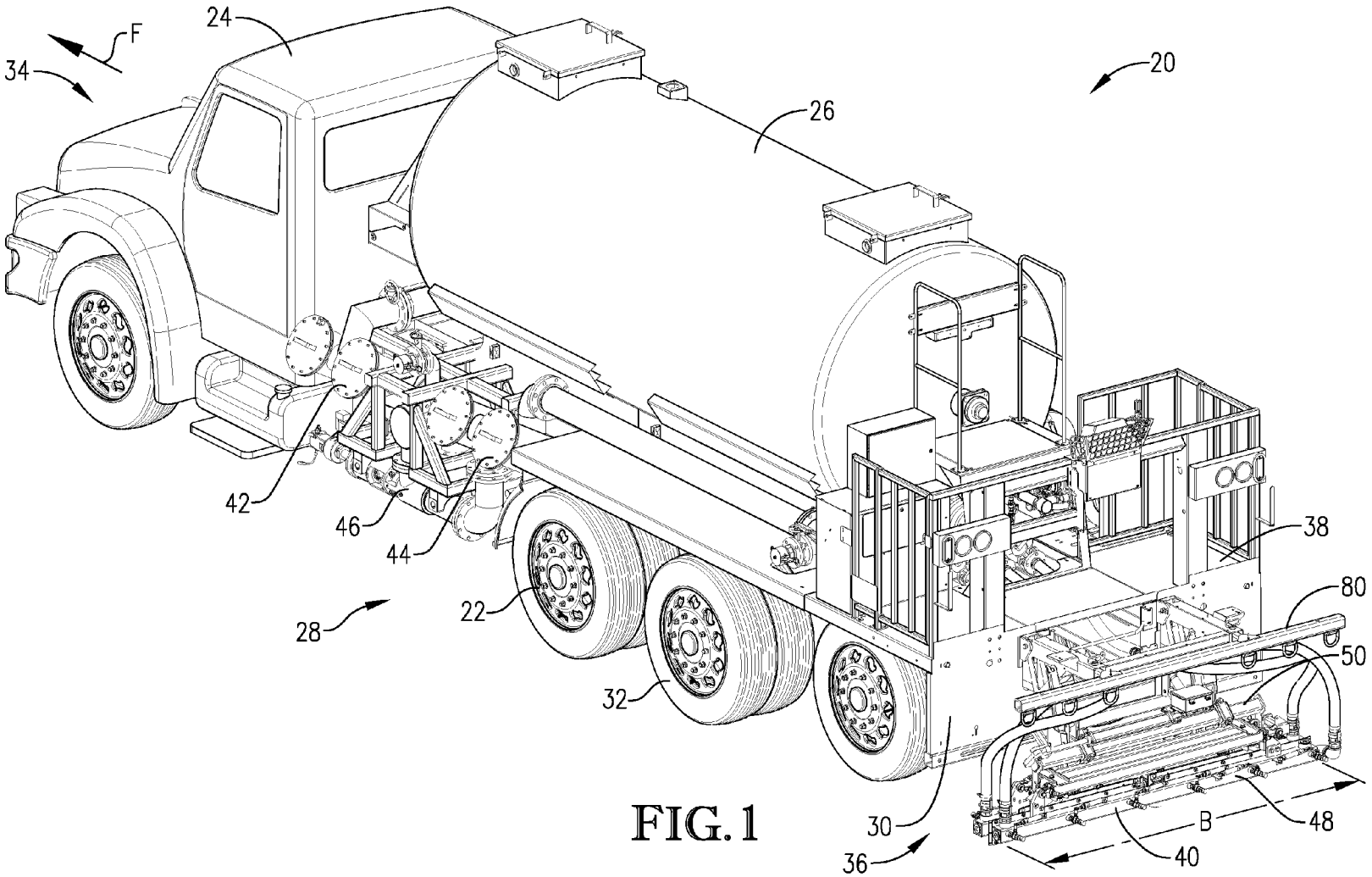
FIG. 1 is a rear perspective of a coating applicator vehicle constructed in accordance with a preferred embodiment of the present invention.
Figure 9:
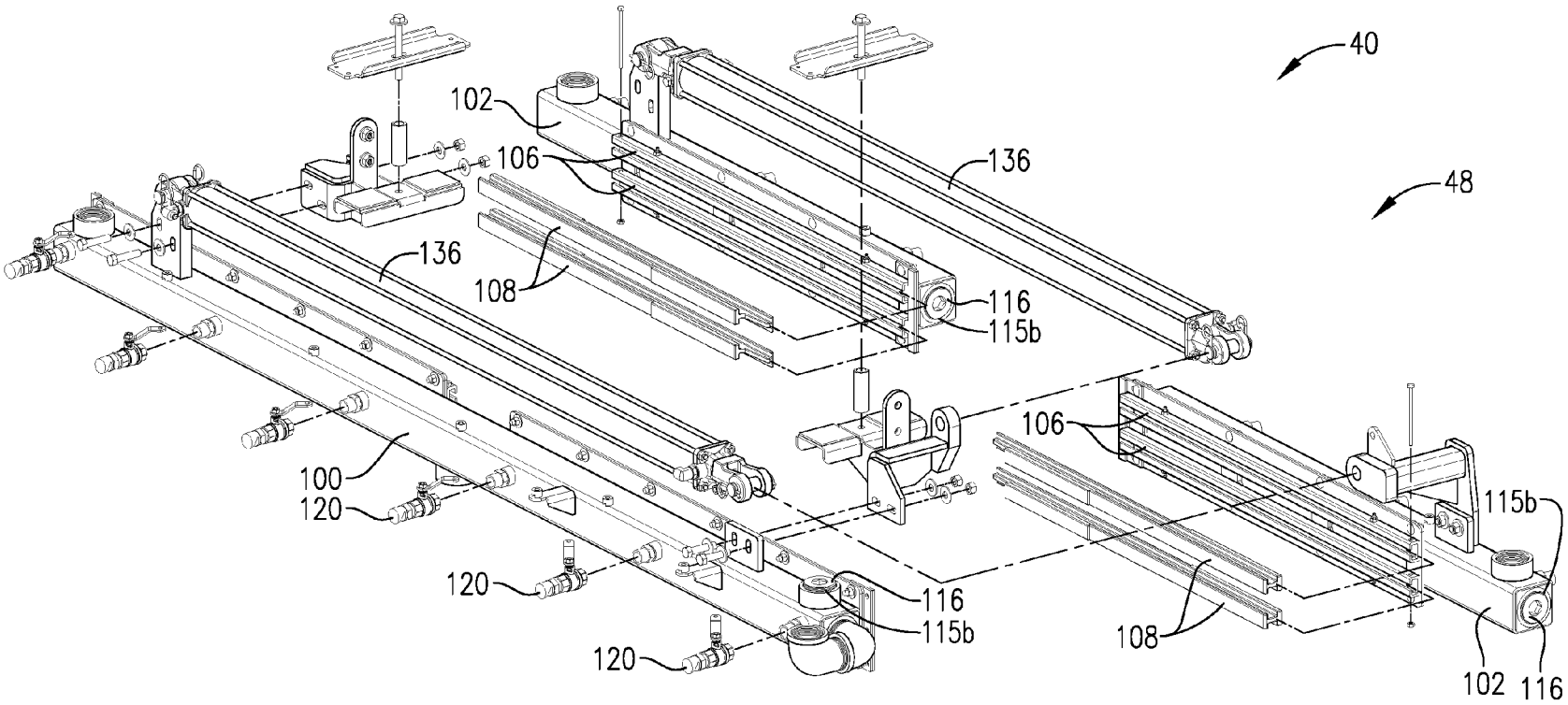
Figure 10:
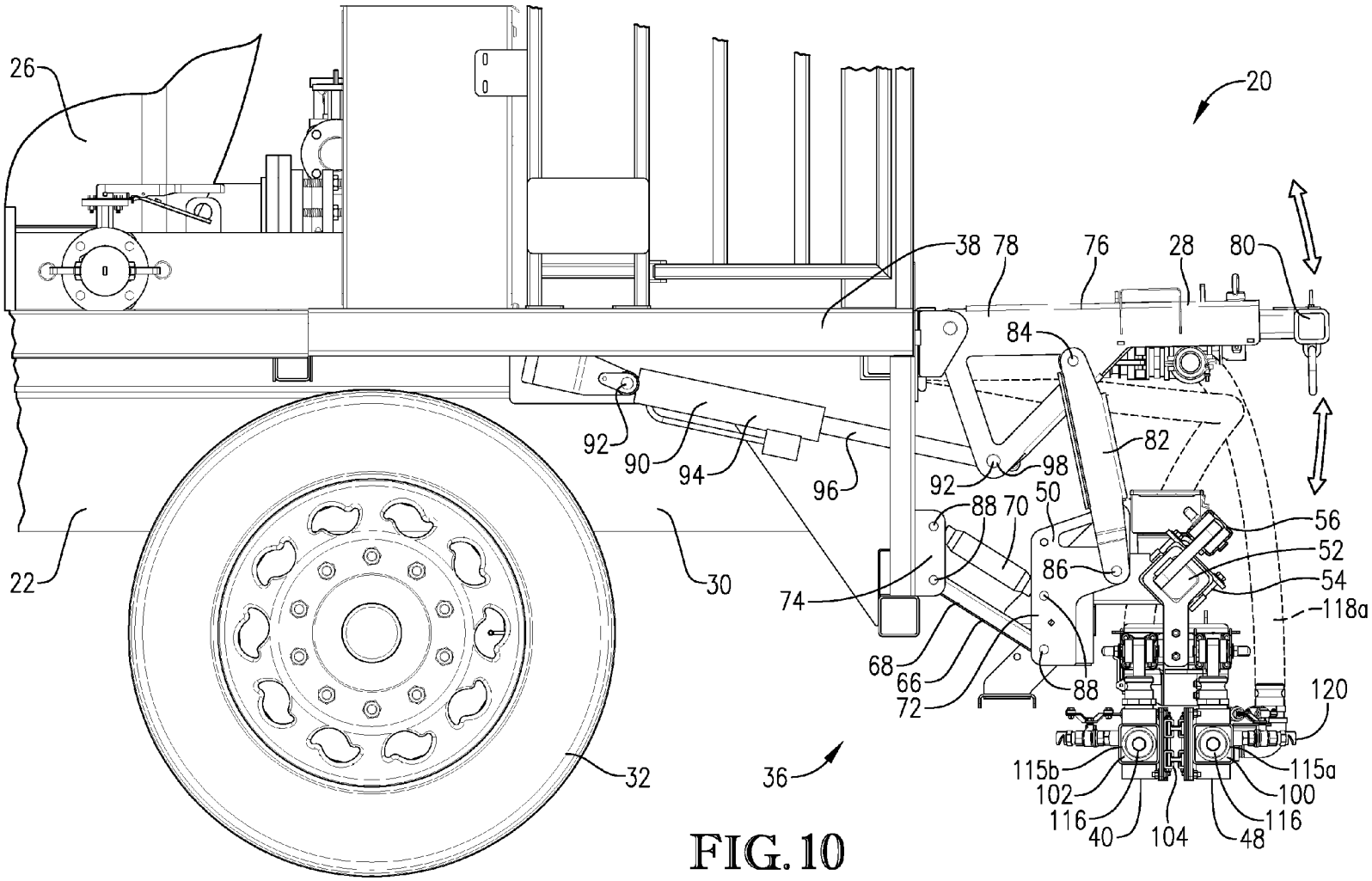
Figure 11:
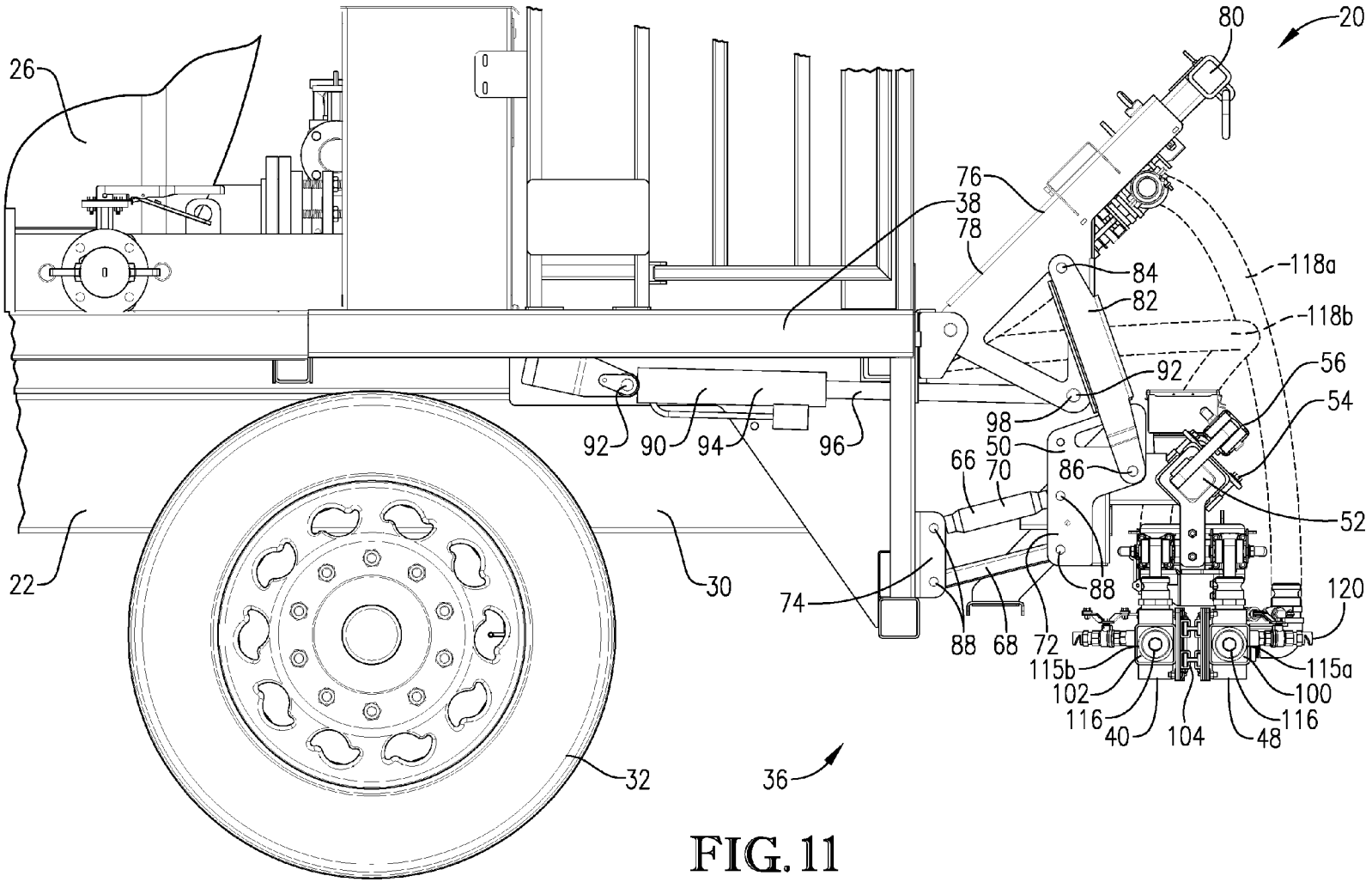
Figure 12:
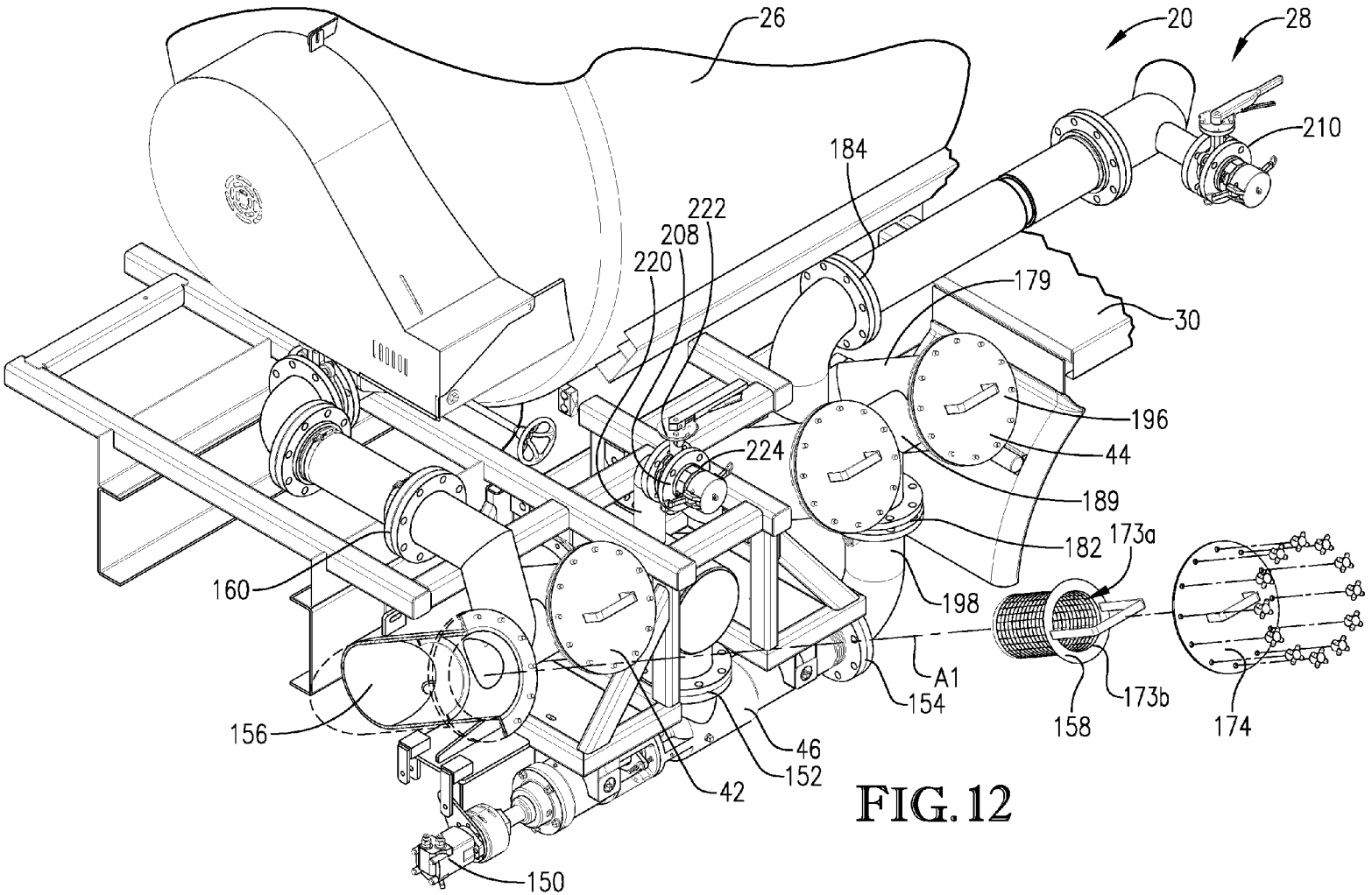
Figure 13:
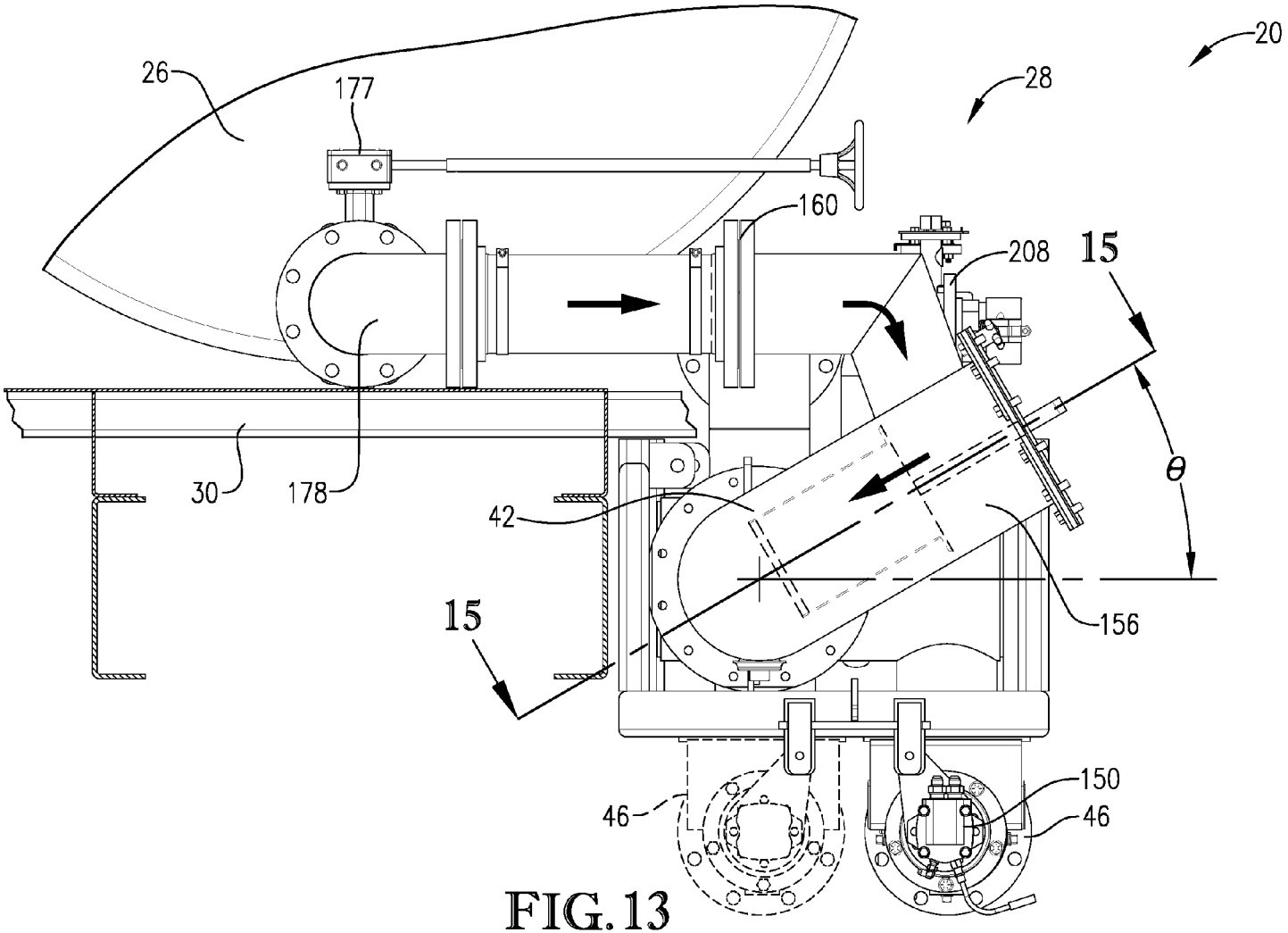
Figure 14:
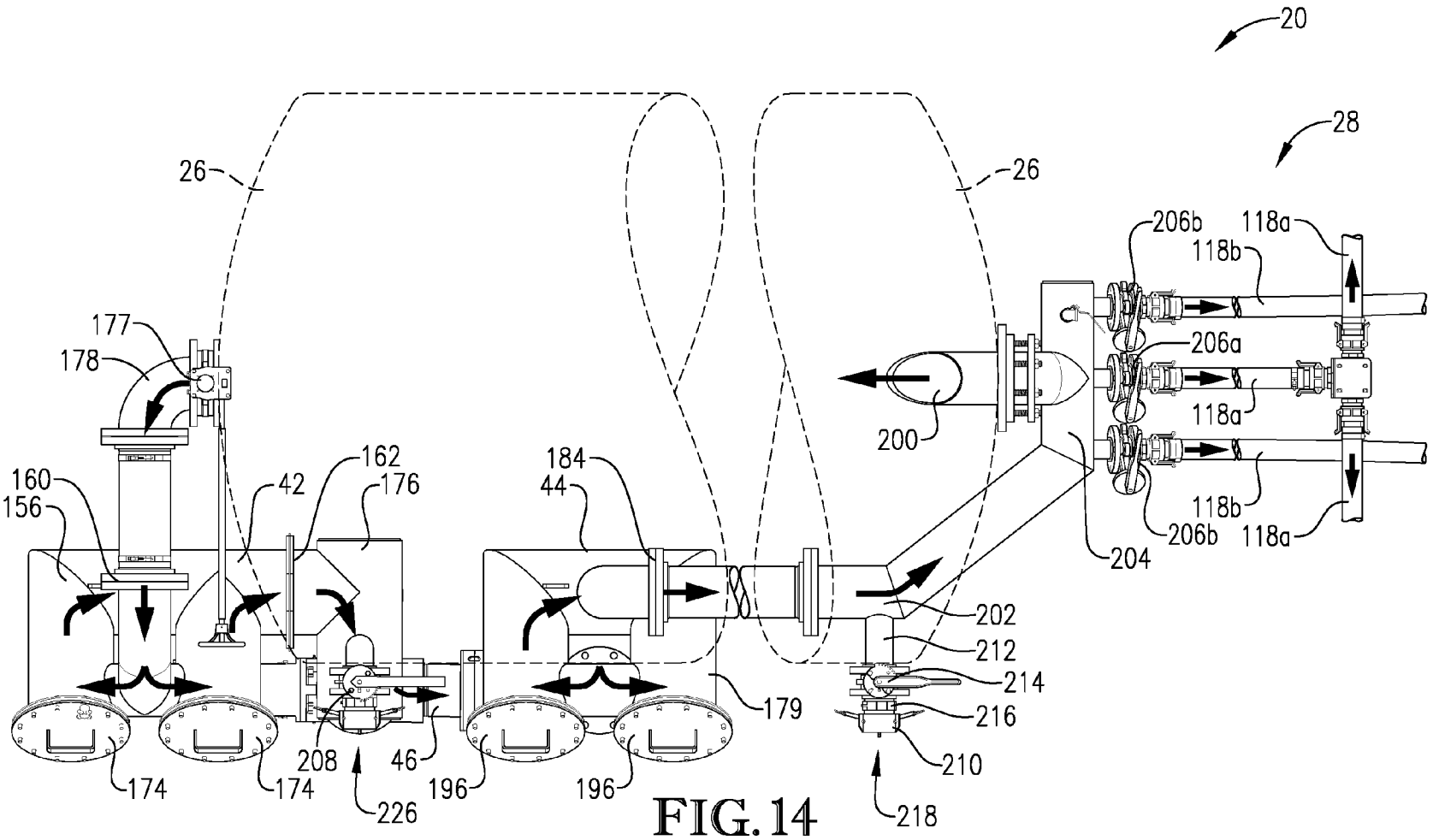
Figure 15:
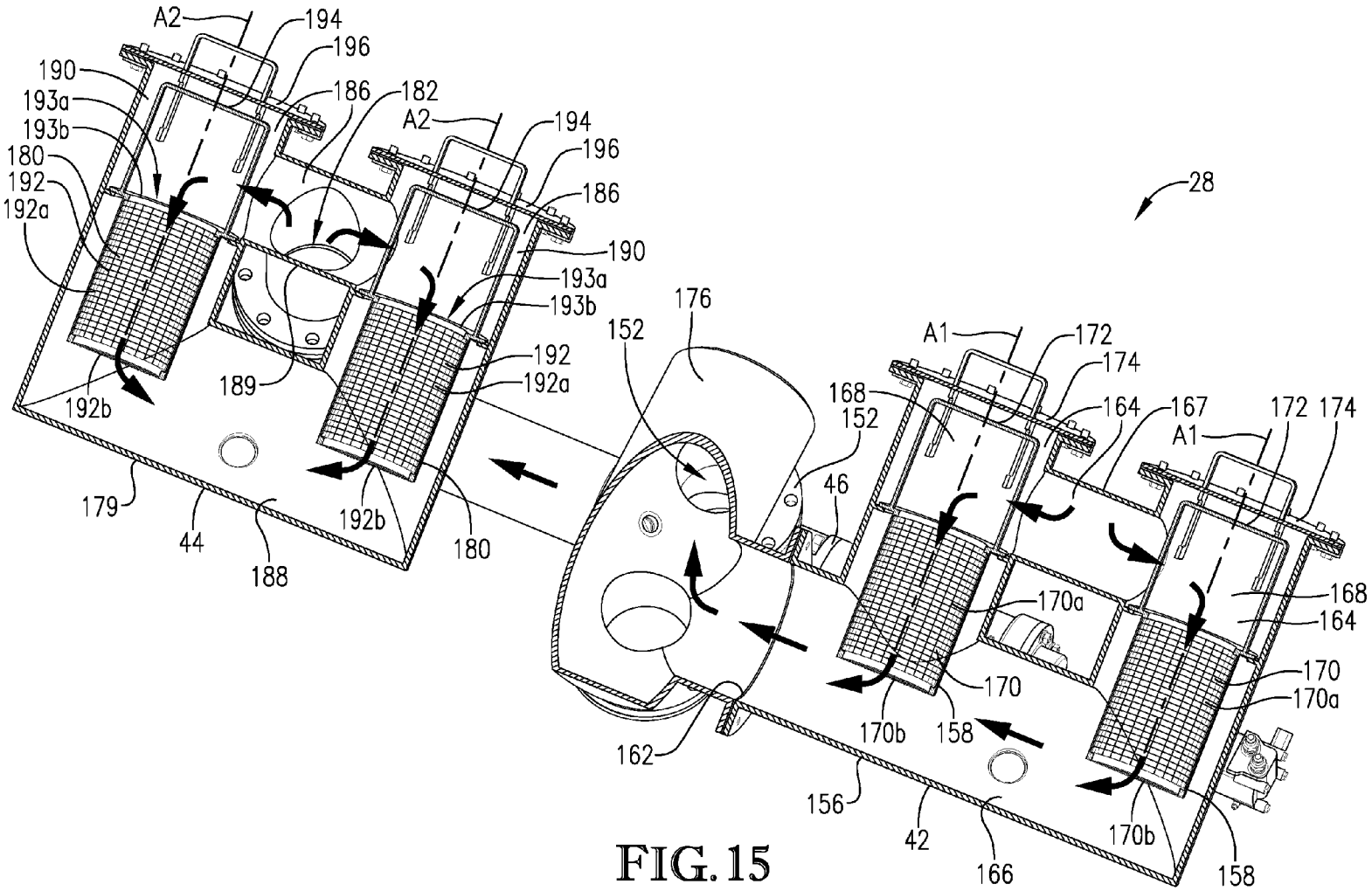
Figure 16:
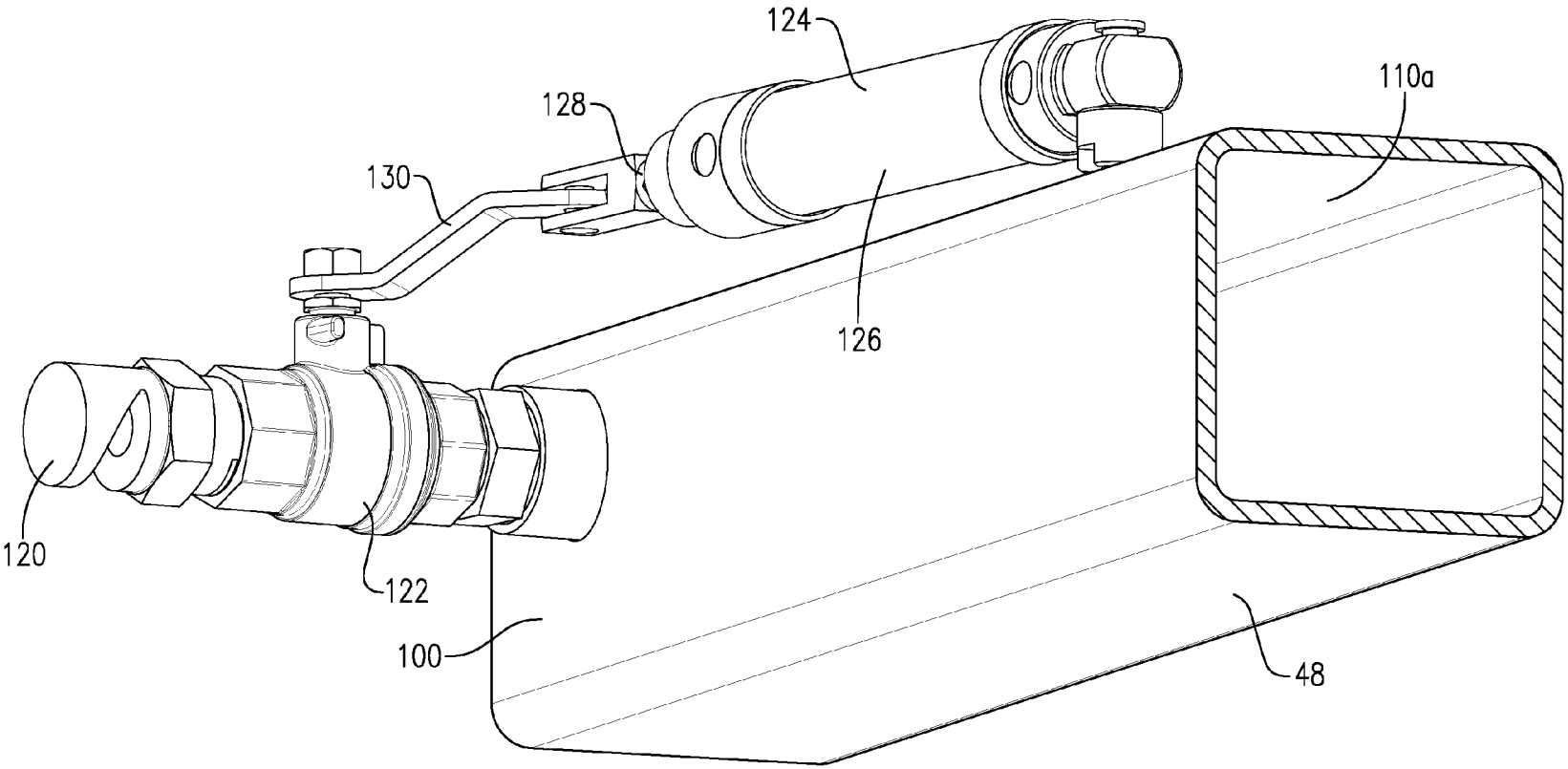
Figure 18:
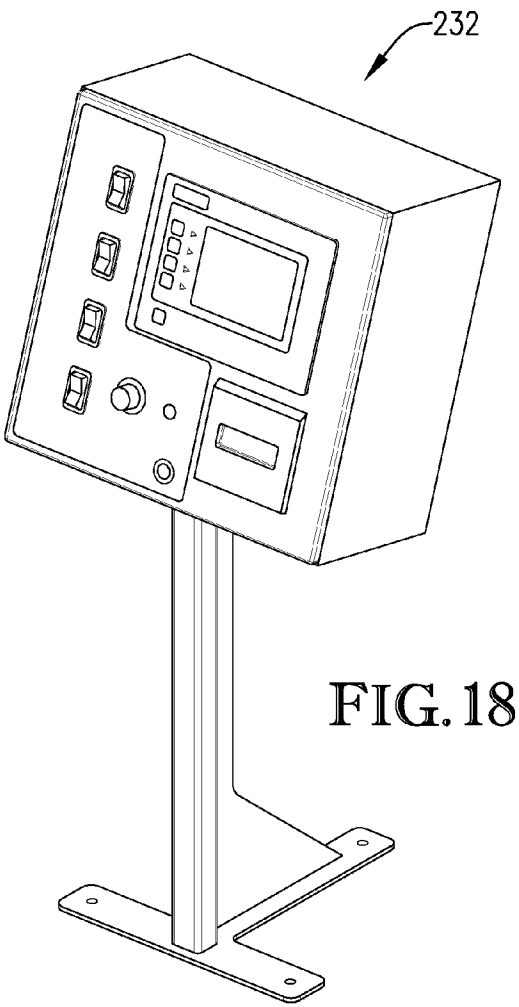
Figure 17:
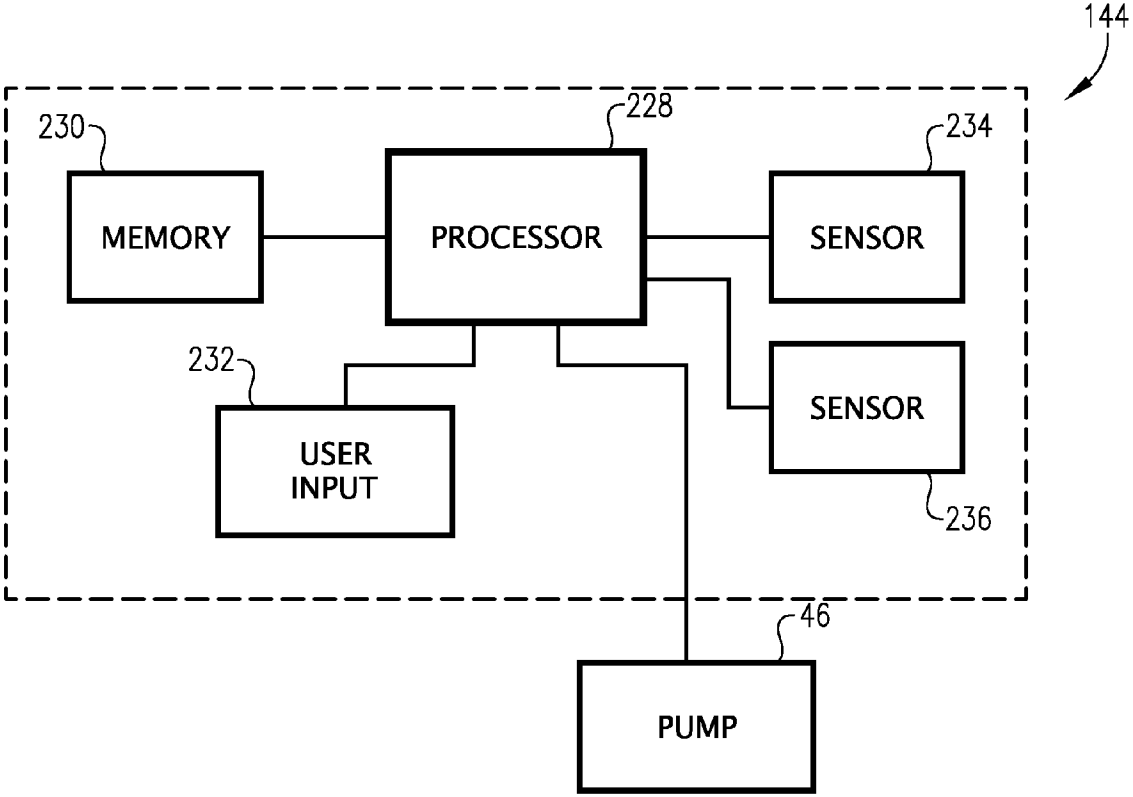

FIG. 9 is an exploded rear perspective of the spray bar assembly shown in FIGS. 1-8;

FIG. 10 is a side elevation of the coating applicator vehicle shown in FIG. 1, showing the spray bar assembly shifted into a lower position;

FIG. 11 is a side elevation of the coating applicator vehicle similar to FIG. 10, but showing the spray bar assembly shifted into an upper position;

FIG. 12 is a fragmentary front perspective of the coating applicator vehicle shown in FIGS. 1, 10, and 11, showing a storage tank mounted on the chassis of the vehicle, and further showing a suction strainer assembly, pressure strainer assembly, and pump of the vehicle;

FIG. 13 is a fragmentary front elevation of the coating applicator vehicle shown in FIGS. 1 and 10-12, showing the suction strainer assembly and pump mounted on the chassis and arranged vertically relative to each other;

FIG. 14 is a fragmentary top view of the coating applicator vehicle shown in FIGS. 1 and 10-13, showing the strainer assemblies in fluid communication with the storage tank and in fluid communication with hoses of the spray bar assembly;

FIG. 15 is a fragmentary cross section of the coating applicator vehicle taken along line 15-15 in FIG. 13;

FIG. 16 is a greatly enlarged view of the spray bar assembly shown in FIGS. 1-9, showing the central boom section, one of multiple valves mounted on the central boom section, one of multiple spray nozzles attached to and fluidly communicating with the valve, and one of multiple valve cylinders supported on the central boom section and operably coupled to the valve;

FIG. 17 is a schematic view of a control system of the coating applicator vehicle shown in FIGS. 1-16; and FIG. 18 is a fragmentary perspective of the control system shown in FIG. 17, showing a user interface device of the control system.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Turning initially to FIG. 1, a coating applicator vehicle 20 is constructed in accordance with a preferred embodiment of the present invention. The illustrated vehicle 20 is preferably used to apply a friction mastic material (not shown) to the surface of a paved road (not shown). In the usual manner, the friction mastic material operates to extend the usable life of a paved asphalt road (or other road surfaces). The friction mastic material preferably comprises a mixture including a liquid emulsion (e.g., an asphalt emulsion), aggregate, and one or more various polymers. However, the friction mastic could be variously configured within the scope of the present invention.

It will also be appreciated that the depicted vehicle 20 could be used to dispense one or more other types of flowable pavement coating materials. For instance, the vehicle 20 could be configured to spray a tack coat material (e.g., onto an existing asphalt surface). The vehicle 20 preferably includes a rolling chassis 22, a cab 24, a drive train (not shown), a storage tank 26, and a spraying assembly 28.

The rolling chassis 22 is conventional and includes an elongated chassis frame 30 and wheels 32 mounted on the chassis frame 30. The chassis frame 30 extends longitudinally to present front and back ends 34,36. The chassis frame 30 supports the cab 24 at the front end 34, a rear deck 38 at the back end 36, and the storage tank 36 between the front and back ends 34,36. The rear deck 38 is preferably fixed to the back end 36 of the chassis frame 30. As will be discussed, a spray bar assembly 40 is preferably attached to and supported by the rear deck 38 adjacent the back end 36 of the frame 30. In the usual manner, the vehicle 20 is advanced along a forward direction F while spraying the flowable pavement coating material along a lateral application spray pattern P (see FIG. 4).

As will be discussed in greater detail, the spraying assembly 28 is operable to pump flowable pavement coating material from the tank 26, strain the pumped material, and dispense the material onto the roadway. The spraying assembly 28 preferably includes the spray bar assembly 40, suction and pressure strainer assemblies 42,44, and pump 46.

Spray Bar Assembly

Turning to FIGS. 2-11 and 16, the spray bar assembly 40 extends transversely to the forward direction F of the vehicle 20 and is operable to spray the flowable pavement coating material onto the pavement. The spray bar assembly 40 preferably includes a spray boom 48 and a spray bar frame 50 that supports the spray boom 48 for vertical and lateral movement relative to the chassis 22.

The spray bar frame 50 is preferably shiftable vertically, relative to the rolling chassis 22 along an upright direction. The spray bar frame 50 is preferably configured to support the spray boom 48 relative to the rolling chassis 22 and to selectively position the spray boom 48 vertically above the pavement. The spray bar frame 50 includes an elongated slider housing 52 that extends laterally, mounting collars 54 attached to the slider housing 52, and a boom shift cylinder 56 (see FIGS. 2 and 3). The slider housing 52 preferably includes an elongated tubular body 58 and a pair of depending arms 60 mounted on respective ends of the body 58.

The mounting collars 54 are interconnected by an elongated collar bracket (not shown). Each collar 54 presents a smooth, generally square bore that slidably receives the tubular body 58. Thus, the collars 54 are preferably permitted to slide laterally relative to the tubular body 58. Because the spray boom 48 interconnects the arms 60, both the arms 60 and the spray boom 48 can move laterally relative to the chassis 22 of the vehicle 20. This slider mechanism preferably permits the entire spray boom 48 to slide laterally (also referred to as "side shift").

The slider mechanism preferably allows the entire spray boom 48 to slide a distance S from a centered position to one laterally endmost shift position. The distance S is preferably about ten inches (10"). Thus, the total lateral travel of the spray boom 48 from one laterally endmost shift position to the opposite laterally endmost shift position is preferably about twenty inches (20"). However, the illustrated slider mechanism could allow either a smaller or greater amount of lateral boom travel.

The boom shift cylinder 56 includes a cylinder housing 62 and a piston 64. The cylinder housing 62 is fixed to the collar bracket (not shown) that extends between the collars 54. The piston 64 of the boom shift cylinder 56 is drivingly attached to one end of the tubular body 58. Extension and retraction of the piston 64 causes the tubular body 58 to slide through the collars 54. Thus, movement of the piston 64 causes the tubular body 58 and the spray boom 48 to shift laterally relative to the chassis 22 of the vehicle 20.

This mechanism for lateral shifting of the spray boom 48 is preferred so that the entire spray boom 48 can be precisely laterally positioned relative to the pavement (e.g., to align one end of the spray boom 48 with an edge of the pavement) without having to change the lateral position of the vehicle 20. This mechanism also permits the spray boom 48 to be laterally aligned with the pavement without having to adjust the width of the spray boom 48.

The boom shift cylinder 56 is conventional and preferably comprises a hydraulic cylinder. However, an alternative drive motor (such as an alternative hydraulic cylinder) could be used to shift the entire spray boom 48. Furthermore, it will be appreciated that other components of the lateral shifting mechanism could be alternatively configured to shift the spray boom 48 laterally. Yet further, for some aspects of the present invention, the vehicle 20 could be devoid of a mechanism to shift the entire spray boom 48 laterally relative to the vehicle 20.

Figure 2:
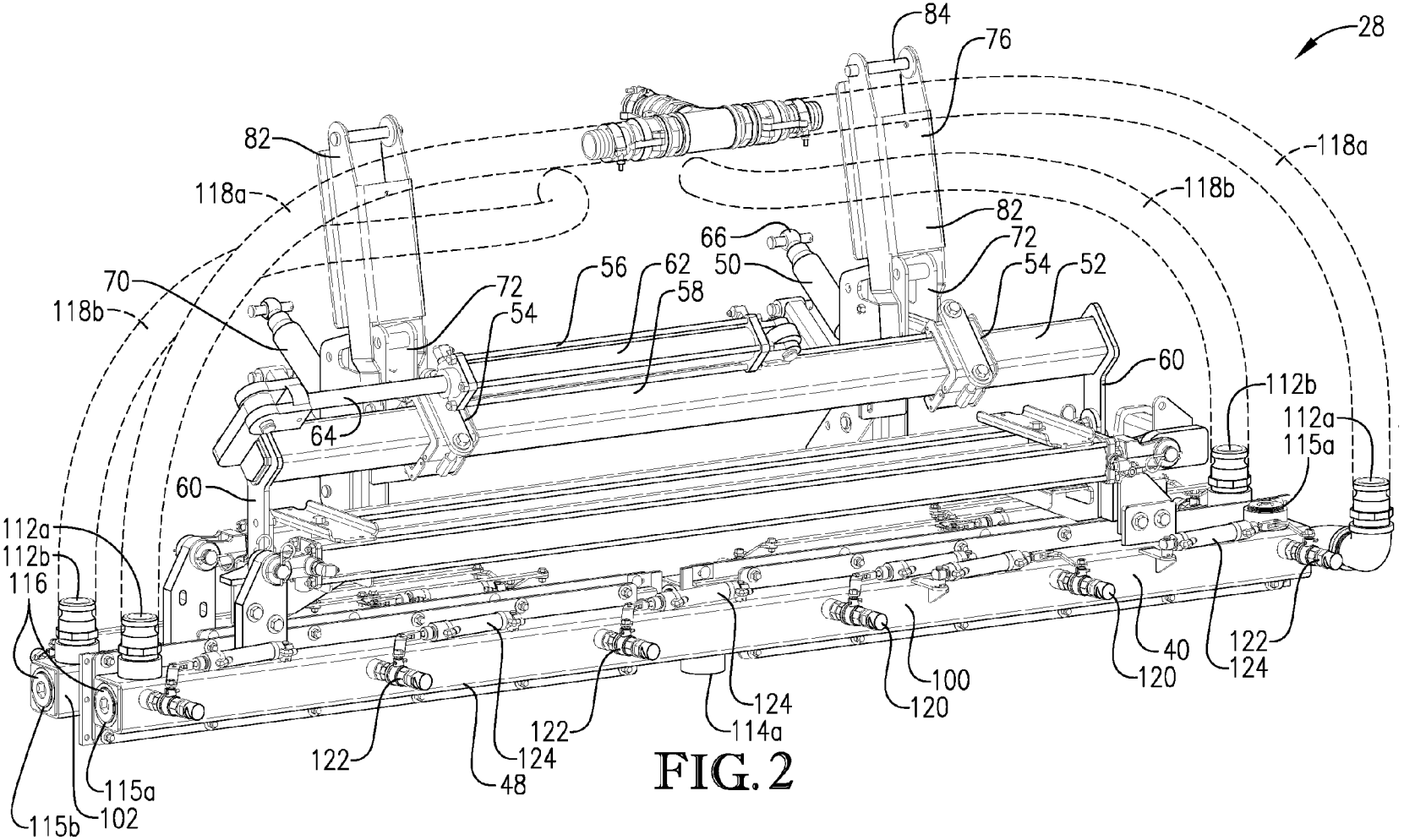
FIG. 2 is a fragmentary rear perspective of the coating applicator vehicle shown in FIG. 1, showing a spray bar assembly of the vehicle.
Figure 3:
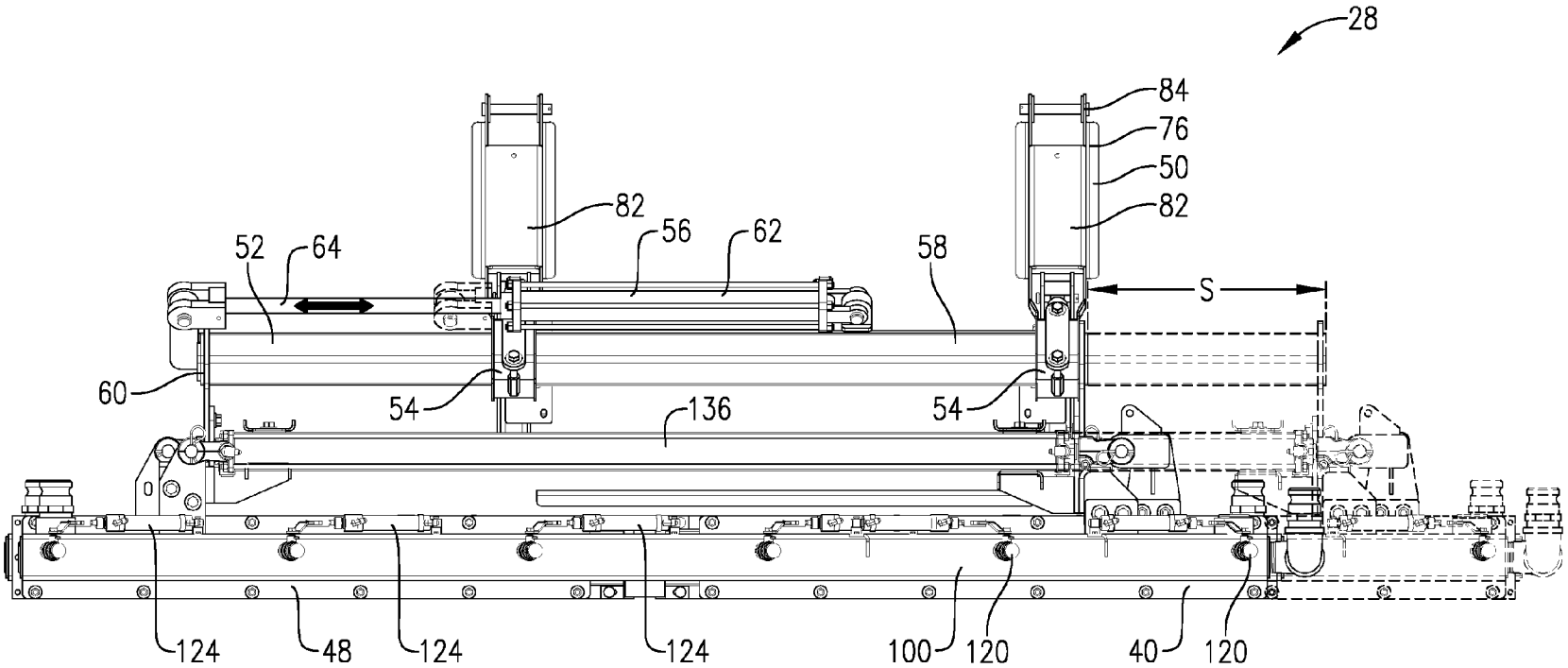
FIG. 3 is a rear elevation of the spray bar assembly shown in FIGS. 1 and 2.

Turning to FIGS. 2, 10, and 11, the spray bar assembly 40 also preferably includes a linkage 66 to mount the spray bar frame 50 rearwardly of the chassis frame 30. In particular, the spray bar assembly 40 is preferably attached to and supported by the rear deck 38. As a result, the spray bar assembly 40 is spaced rearwardly of the back end 36 of the frame 30. The linkage 66 preferably includes a pair of rigid links 68, a pair of turnbuckle links 70, a pair of collar support brackets 72, and a pair of frame mounting brackets 74. Each link 68,70 is pivotally attached at an aft end thereof to one of the support brackets 72. The support brackets 72 are attached to corresponding ones of the collars 54.

The links 68 each present a fixed length. However, the turnbuckle links 70 each comprise a turnbuckle mechanism to adjust the length of the turnbuckle link 70. However, the fixed link 68 and/or turnbuckle links 70 could be alternatively configured without departing from the scope of the present invention.

The forward ends of the links 68,70 are pivotally attached to mounting brackets 74 fixed to the frame 30. Thus, the links 68,70, support brackets 72, mounting brackets 74, and spray bar frame 50 cooperatively form a four-bar linkage that permits the spray bar frame 50 to shift vertically relative to the chassis frame 30.

The illustrated spray bar assembly 40 also includes a hanger frame 76 that is operable to support the spray bar frame 50 and other equipment (such as material hoses). The hanger frame 76 includes a pair of hanger arms 78 and a lateral beam 80 (see FIG. 1) that interconnects the hanger arms 78. A forward end of each hanger arm 78 is pivotally attached to the chassis frame 30 above the spray bar frame 50 so that the hanger frame 76 can pivot vertically about a lateral pivot axis.

The hanger frame 76 further includes hanger links 82 that interconnect the hanger frame 76 and the spray bar frame 50. In particular, upper ends 84 of each hanger link 82 are pivotally attached to the corresponding hanger arm 78 between the ends thereof (see FIGS. 10 and 11). Lower ends 86 of each hanger link 82 are pivotally attached to the support brackets 72 of the spray bar frame 50 (see FIGS. 10 and 11). Thus, pivotal up-and-down movement of the hanger frame 76 causes corresponding vertical movement of the spray bar frame 50.

Figure 5:
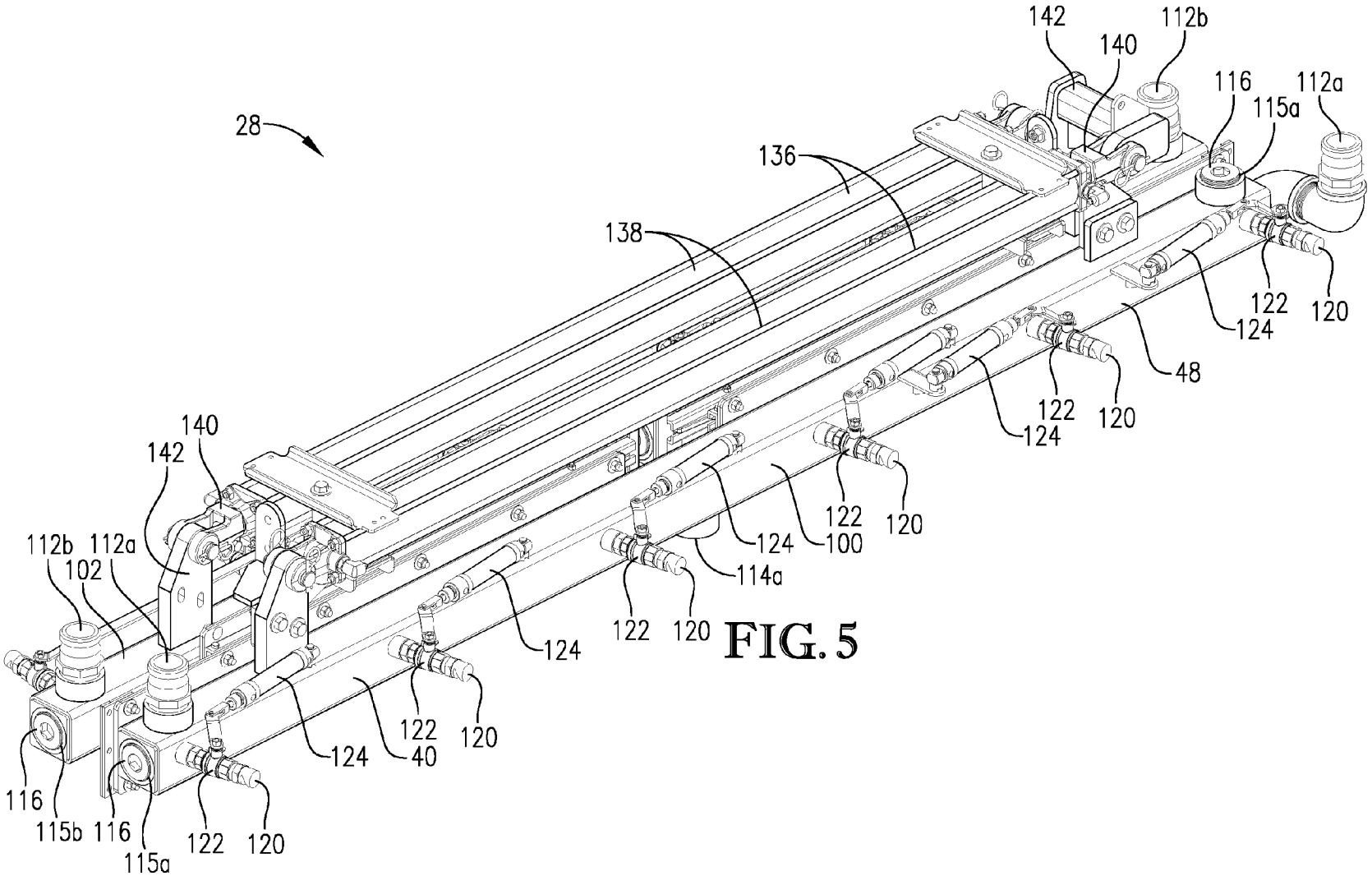
FIG. 5 is a fragmentary upper rear perspective of the spray bar assembly shown in FIGS. 1-4.
Figure 6:
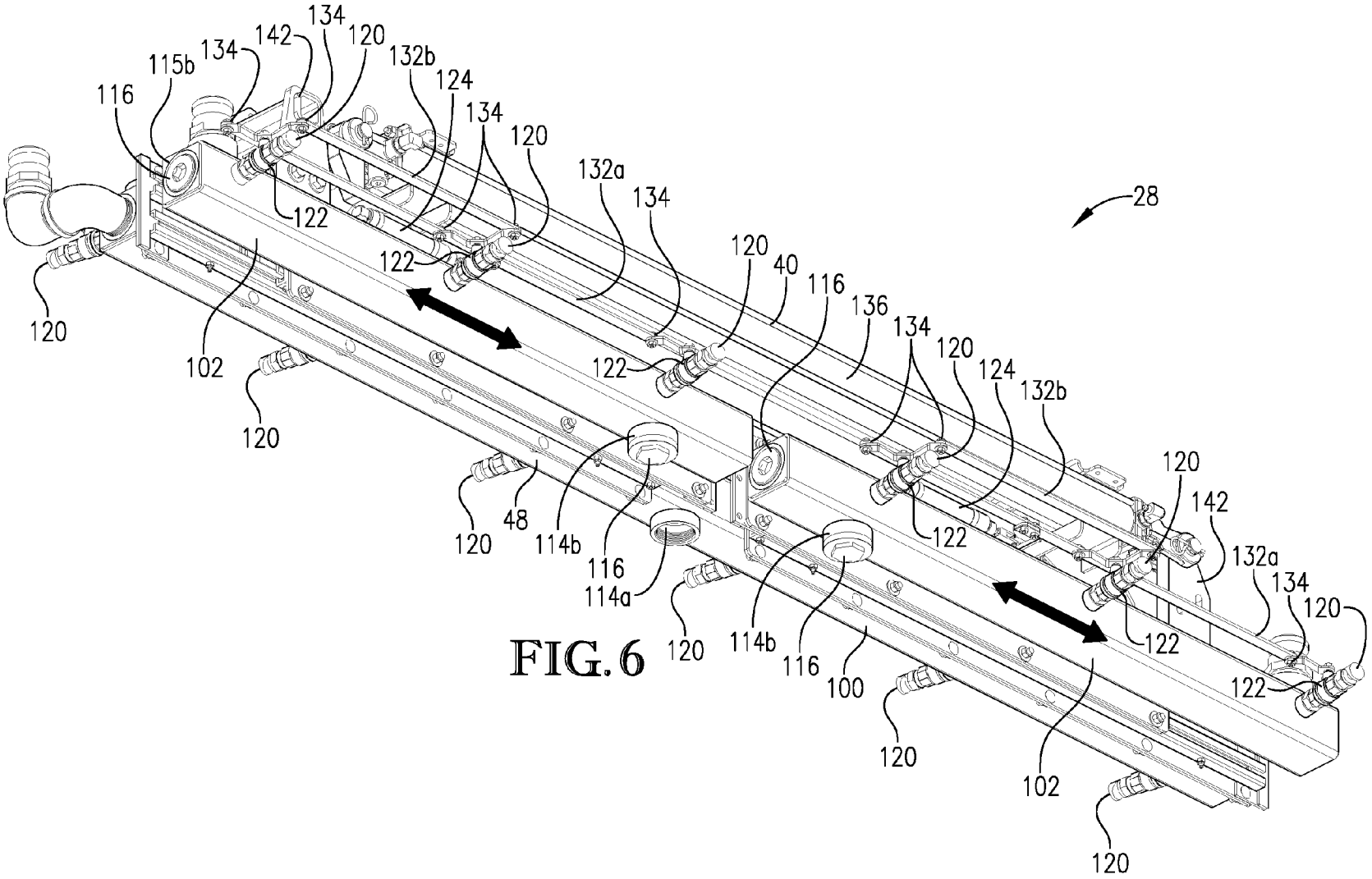
FIG. 6 is a fragmentary lower front perspective of the spray bar assembly shown in FIGS. 1-5, showing a central boom section and opposite extendable boom sections, with the extendable boom sections being in a retracted position.

Preferably, the spray bar assembly 40 and the hanger frame 76 are removably mounted with quick-connect pins 88 that permit the spray bar assembly 40 to be quickly attached and removed from the vehicle 20 (see FIG. 5). Specifically, the links 68,70 are pivotally attached to the brackets 72,74 with quick-connect pins 88. The hanger links 82 are connected to the support brackets 72 and the hanger arms 78 with quick-connect pins 88 (see FIGS. 10 and 11). Also, the hanger arms 78 are connected to the chassis frame 30 and to a hydraulic lift cylinder 90 with quick-connect pins 92 (see FIGS. 10 and 11). The illustrated pins 92 preferably include threaded bolts, but alternative pin fasteners could be used to provide a quick-connection arrangement.

The spray bar assembly 40 further includes the hydraulic lift cylinder 90 to provide a motor operable to shift the spray bar frame 50 and the spray boom 48 vertically relative to the rolling chassis 22. The lift cylinder 90 includes a cylinder housing 94 and a piston 96. The cylinder housing 94 is mounted to the chassis frame 30 so that the piston 96 extends longitudinally along and projects rearwardly of the chassis frame 30. The end of the piston 96 is pivotally attached to one of the hanger arms 78 at a pivot joint 98 spaced from the ends of the one hanger arm 78. Thus, as the piston 96 is hydraulically extended and retracted relative to the housing 94, the hanger frame 76 correspondingly pivots up and down relative to the chassis frame 30. Consequently, extension and retraction of the piston 96 preferably causes corresponding up and down vertical shifting movement of the spray bar frame 50 and the spray boom 48. The lift cylinder 90 is preferably conventional and comprises a hydraulic cylinder, although an alternative powered motor could be used to selectively raise and lower the spray bar assembly 40.

Turning to FIGS. 2-11 and 16, the spray boom 48 preferably includes a central boom section 100 and extendable boom sections 102 slidably attached to the central boom section 100 with a slide mechanism 104. The slide mechanism 104 includes channels 106 and slides 108 (see FIGS. 8 and 9), with the channels 106 being fixed to corresponding boom sections 100,102. The boom sections 100,102 are preferably hollow and present corresponding elongated chambers 110*a,b* (see FIG. 8) and chamber inlets 112*a,b* (see FIGS. 2 and 5). The boom sections 100,102 also preferably present drain outlets 114*a,b* (see FIG. 6), access openings 115*a,b*, and plugs 116 removably inserted in the outlets 114.

The illustrated spray boom 48 is preferably configured so that the boom sections 100,102 extend along a common lateral direction and are generally parallel to one another and to the common lateral direction. However, it is within the scope of the present invention where one or more of the boom sections 100,102 is alternatively positioned.

Preferably, the slide mechanism 104 permits the extendable boom sections 102 to slide relative to the central boom section 100 along the common lateral direction. In the illustrated embodiment, the boom sections 102 are preferably slidable between a retracted position (see FIGS. 2-6) and an outermost deployed position (see FIGS. 7*a* and 7*b*) such that the spray boom 48 has an adjustable boom width B (see FIG. 1). In the retracted position, the extendable boom sections 102 overlap corresponding portions of the central boom section 100, with the boom sections 100,102 cooperatively defining a minimum boom width dimension.

In the outermost deployed position, the extendable boom sections 102 are shifted in opposite outboard directions to project laterally outboard from lateral ends of the central boom section 100. It will also be appreciated that each boom section 102 can be shifted outboard from the retracted position to any deployed position located between the retracted position and the outermost deployed position.

For some aspects of the present invention, the boom sections 100,102 could be alternatively shiftably attached to one another. For instance, the extendable boom sections 102 could be pivotally mounted relative to the central boom section 100 so that the boom sections 102 are swingable relative to the central boom section 100 (e.g., between a retracted position and an outermost deployed position).

The chamber inlets 112*a,b* are preferably fluidly connected to corresponding supply hoses 118*a,b* (see FIGS. 2 and 14). Each chamber 110 is operable to receive the coating material and distribute the coating material laterally along the width of the corresponding boom section 100,102. However, it is within the scope of the present invention where the boom sections 100,102 are alternatively configured to carry and distribute the coating material. For instance, each boom section 100,102 could have a hose (not shown), located internally or externally relative to the boom section 100,102, to distribute coating material along the width of the boom section 100,102. As will be discussed, each boom section 100,102 is configured to supply coating material to corresponding spray nozzles 120.

Again, the extendable boom sections 100,102 are slidable between retracted and outermost deployed positions such that the spray boom 48 has an adjustable boom width B (see FIG. 1). In the illustrated embodiment, the boom width B is preferably adjustable from about eight feet (8 ft) in the retracted position to about eighteen feet (18 ft) in the outermost deployed position. In the outermost deployed position, the spray nozzles 120 preferably spray material so that the spray application pattern P has a maximum spray width A (see FIG. 4) of about twenty feet (20 ft). However, it is within the scope of the present invention where the spray boom 48 has an alternative range of boom width B and/or spray width A. Also, for some aspects of the present invention, the spray boom 48 could have a fixed boom width.

In the retracted position, the vehicle 20 preferably presents a maximum vehicle width that is less than two and one half meters (2.5 m), which is the maximum legal vehicle width allowed by law in a number of foreign countries.

Referring again to FIGS. 2-11 and 16, the spray bar assembly 40 preferably includes the spray nozzles 120, valves 122, and valve cylinders 124 (see FIGS. 5 and 6). In the usual manner, the spray nozzles 120 are operable to spray the flowable pavement coating material onto the pavement. Each boom section 100,102 preferably supports and supplies material to a plurality of spray nozzles 120 along the width of the boom section 100,102. The spray nozzles 120 fluidly communicate with a corresponding one of the chambers 110 to receive a flow of coating material from the spray boom 48 and discharge the coating material. It will be appreciated that one or more of the boom sections 100,102 could have an alternative number and/or configuration of spray nozzles 120.

Each valve 122 preferably comprises a ball valve although, for some aspects of the present invention, the valves 122 could be alternatively configured to selectively fluidly interconnect the chamber 110 and the corresponding nozzle 120. Each spray nozzle 120 is preferably fluidly connected to the chamber 110*a,b* of the corresponding boom section 100,102 by one of the valves 122. Thus, the flow of coating material through each spray nozzle 120 is preferably controlled by the corresponding valve 122 (i.e., by opening or closing the valve 122).

Each spray nozzle 120 preferably discharges coating material in a generally planar fan pattern. The illustrated spray nozzles 120 each present an orifice (not shown) with an orifice diameter dimension that ranges from about five sixteenths of an inch (5/16") to about one half of an inch (1/2") and, more preferably, is about three eighths of an inch (3/8"). The orifice diameter dimension is preferably about twice the size of the maximum aggregate size allowed by the strainer systems of the vehicle 20 to pass to the spray boom 48. Thus, because the strainer assemblies preferably permit a maximum aggregate size of about three sixteenths of an inch (3/16") to pass through to the spray boom 48, the more preferred orifice diameter dimension is about three eighths of an inch (3/8").

Figure 4:
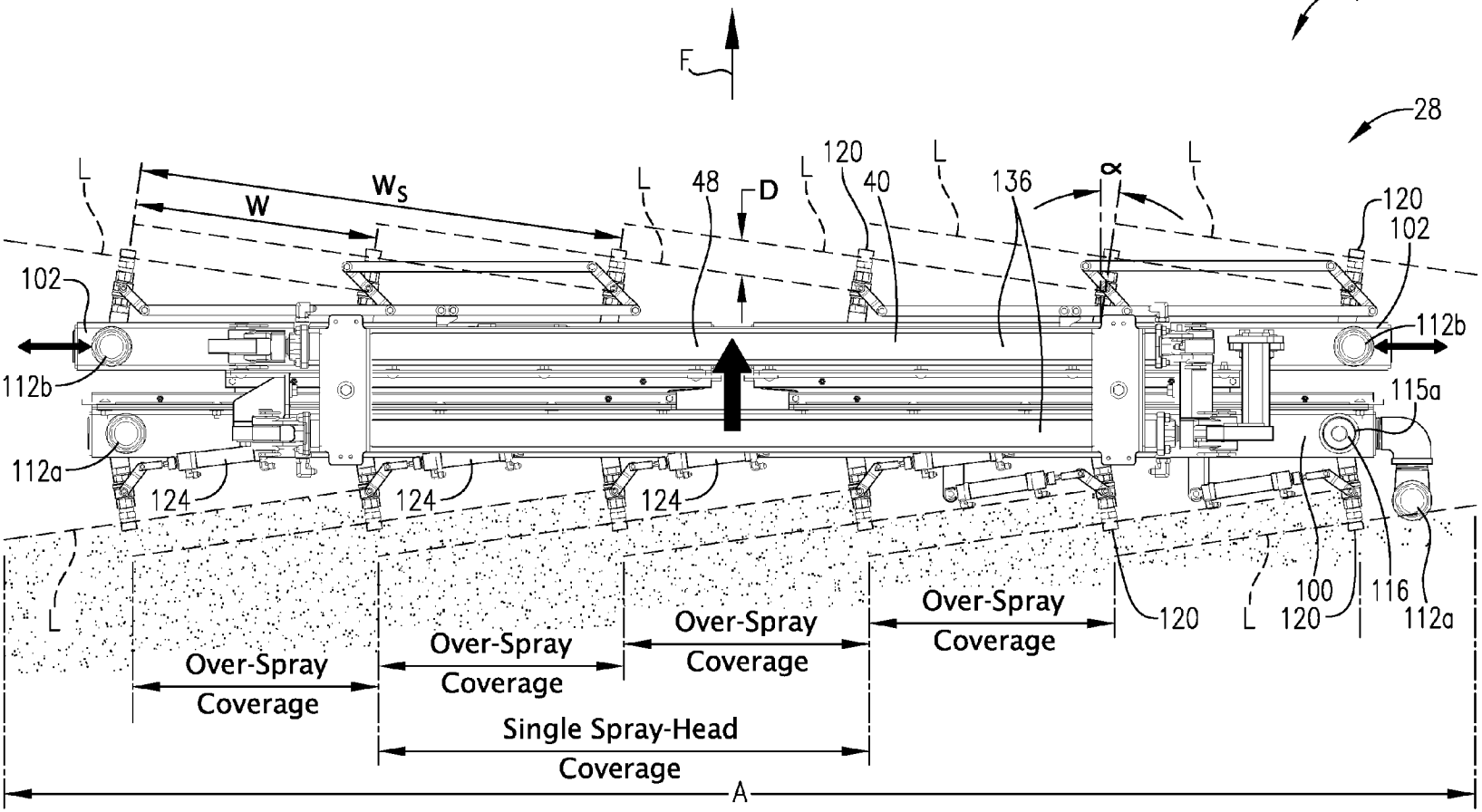
FIG. 4 is a fragmentary top view of the spray bar assembly shown in FIGS. 1-3.

Each spray nozzle 120 preferably discharges the coating material in a generally planar fan pattern that impinges the roadway along a laterally extending spray line L (see FIG. 4). To discharge coating material in the form of a generally planar fan pattern, the spray nozzle 120 preferably includes an endmost ledge that redirects material flow from the orifice in a downward direction.

The illustrated spray nozzles 120 are preferably arranged so that the spray line L is at an acute angle relative to the common lateral direction of the boom sections 100,102. In other words, the spray nozzles 120 are preferably arranged so that a line perpendicular to the spray line L and the forward direction F cooperatively define an acute spray angle $\alpha$ (see FIG. 4). The spray angle $\alpha$ preferably ranges from about five degrees (5°) to about ten degrees (10°) and, more preferably, is about eight degrees (8°). However, for some aspects of the present invention, the nozzle orientation could fall outside of the preferred range.

The spray nozzles 120 are also preferably oriented so that the spray lines L associated with each boom section 100,102 are generally parallel to one another. For instance, the spray lines L produced by the spray nozzles 120 of the central boom section 100 are generally parallel to each other. Thus, for each boom section 100, adjacent pairs of spray nozzles form spray lines L that define an offset distance D (see FIG. 4). It has been found that the illustrated offset distance D permits the planar fan patterns of each spray nozzle 120 to overlap one another without causing the fan patterns to interfere with one another. The spray nozzles 120 are preferably positioned and configured so that the offset distance D ranges from about one inch (1") to about four inches (4"), although the offset distance D could fall outside of this range.

The spray nozzles 120 each preferably present a maximum fan width dimension $W_S$ (see FIG. 4) that ranges from about thirty inches (30") to about forty inches (40") and, more preferably, is about thirty-six inches (36"). While the illustrated configuration of spray nozzles 120 is preferred, an alternative nozzle configuration could be used with the illustrated spray bar assembly 40.

The spray nozzles 120 associated with each of the boom sections 100,102 are preferably spaced in series to form a corresponding lateral line of spray nozzles 120 (see FIG. 4). The lateral lines of spray nozzles 120 for the extendable boom sections 102 are preferably located forwardly of the extendable boom sections 102. Also, the lateral line of spray nozzles 120 for the central boom section 100 is preferably located rearwardly of the central boom section 100. This arrangement of spray nozzles 120 permits the extendable boom sections 102 to at least partly overlap corresponding portions of the central boom section 100 (e.g., when the boom sections 102 are in the retracted position). However, the spray nozzles 120 could be alternatively positioned relative to boom sections 100,102 without departing from the scope of the present invention.

Preferably, the lateral lines of spray nozzles 120 are generally parallel to one another and substantially perpendicular to the forward direction F. Furthermore, each lateral line of spray nozzles 120 in the illustrated embodiment is substantially parallel to the corresponding boom section 100,102 that supports and fluidly communicates the spray nozzles 120. However, it is within the scope of the present invention the lateral lines of spray nozzles 120 are alternatively oriented.

The spray nozzles 120 are preferably positioned so that adjacent spray nozzles 120 cooperatively define a spacing dimension W (see FIG. 4) that ranges between about twelve inches (12") and about thirty inches (30") and, more preferably, is about eighteen inches (18"). For the illustrated invention, it is also preferable that the maximum fan width dimension $W_S$ is about twice the length of the spacing dimension W.

Again, the spray bar assembly 40 preferably includes valve cylinders 124 to control opening and closing of the valves 122. In the usual manner, each valve cylinder 124 includes a cylinder housing 126 and an elongated piston 128 (see FIG. 16). The valve cylinders 124 are conventional and preferably comprise a hydraulic cylinder. However, an alternative powered motor could be used to shift the valves between open and closed positions.

For the central boom section 100, each valve 122 is operably connected to one of the valve cylinders 124. More particularly, the housing 126 of each valve cylinder 124 is pivotally attached to the central boom section 100, with the piston 128 being pivotally attached to a handle 130 of the valve 122 (see FIG. 16). As the piston 128 extends and retracts, the valve handle 130 opens and closes the valve 122. Thus, for the central boom section 100, the valves 122 are preferably opened and closed independently of one another. However, it is within the ambit of the present invention where the spray bar assembly 40 is configured so that the valves 122 of the central boom section 100 are operably linked together (e.g., using a mechanical linkage or an electronic control) so as to open and close at the same time.

The spray bar assembly 40 also includes valve links 132*a,b* (see FIGS. 6, 7*a*, and 7*b*) associated with respective extendable boom sections 102. Specifically, each valve link 132 is pivotally attached to the valve handles 130 of the corresponding extendable boom section 102 at pivots 134. Preferably, each valve link 132 is configured so that the valve handles 130 are simultaneously opened and simultaneously closed. While the illustrated valve link 132 is preferred to open and close the valves 122 simultaneously, it is within the scope of the present invention where an electronic controller is used instead of the mechanical linkage to provide simultaneous opening and closing operation. Also, it is within the ambit of the present invention where the spray bar assembly 40 is configured so that the valves 122 of the extendable boom sections 102 can be opened and closed independently of one another.

For each of the extendable boom sections 102, the valve cylinder 124 is operably connected to the valve handle 130 of a middle one of the valves 122. Specifically, the housing 126 of each valve cylinder 124 is pivotally attached to the corresponding extendable boom section 102, with the piston 128 being pivotally attached to the valve handle 130 of the middle valve 122. Thus, as the piston 128 of a corresponding boom section 102 extends and retracts, the associated valve handles 130 open and close the respective valves 122 at the same time.

The spray bar assembly 40 further includes boom extension cylinders 136 that are used to selectively extend and retract the extendable boom sections 102 (see FIGS. 5-7*b*). Again, the extendable boom sections 102 are slidable between a retracted position (see FIGS. 5 and 6) and an extended position (see FIGS. 7*a* and 7*b*). The extension cylinders 136 each include a cylinder housing 138 and a piston 140 slidable into and out of the housing 138. The housing are fixed relative to the central boom section 100. Each piston 140 is attached to a bracket 142 (see FIGS. 5 and 6) of the corresponding extendable boom section 102. Thus, as each piston 140 slides out of the housing 138 and into the housing 138, the corresponding extendable boom section 102 is extended and retracted. Consequently, the extendable boom sections 102 are preferably movable independently of one another. The extension cylinders 136 are conventional and preferably comprise a hydraulic cylinder. However, the spray bar assembly 40 could be alternatively configured to extend and retract the spray boom 48. For instance, the spray bar assembly 40 could use a single extension cylinder 136 to extend and retract both of the extendable boom sections 102.

When the spray boom 48 is in the retracted position, spray nozzles 120 of the extendable boom sections 102 are substantially laterally aligned with the spray nozzles 120 of the central boom section 100. Thus, when retracted, the valves 122 of the extendable boom sections 102 are preferably closed (i.e., so that only the valves 122 of the central boom section 100 are open). This configuration is preferred to avoid applying too much coating material on any area of the pavement.

When the spray boom 48 is in the extended position, the valves 122 of the boom sections 102 can all be opened. Because of the locations of spray nozzles 120 in the extended position, the spray nozzles 120 are all operated to provide uniform coverage of coating material.

When one of the extendable boom sections 102 is intermediately located between the extended and retracted positions, the valves 122 of the extendable boom section 102 are all opened. At the same time, at least one of the valves 122 of the central boom section 100 is closed, depending how much the extendable boom section overlaps the central boom section. For instance, if the extendable boom section 102 is intermediately positioned so that an inboard one of the spray nozzles 120 of the extendable boom section 102 is laterally aligned with an outboard one of the spray nozzles 120 of the central boom section 100, the valve 122 corresponding to the outboard spray nozzle 120 of the central boom section 100 is closed. Similarly, if the extendable boom section 102 is intermediately positioned so that two inboard spray nozzles 120 of the extendable boom section 102 are laterally aligned with two outboard nozzles 120 of the central boom section 100, the valves 122 corresponding to the outboard spray nozzles 120 of the central boom section 100 are closed. This configuration is preferred so as to avoid applying too much coating material on any area of the pavement.

In the illustrated embodiment, selective opening and closing of the valves 122 of the central boom section 100 when one or both of the extendable boom sections 102 are in an intermediate position can be done manually by the operator. However, as will be discussed, the spraying assembly 28 preferably includes a control system 144 (see FIG.

17) to automatically close valves 122 of the central boom section 100 (e.g., so as to turn off one of a pair of laterally overlapping spray nozzles 120).

Pump, Strainer, and Material Transfer Components

Turning to FIGS. 12-15, the spraying assembly 28 preferably includes the suction strainer assembly 42, the pressure strainer assembly 44, and the pump 46. As will be discussed, the pump 46 is configured draw coating material from the tank 26 and to move coating material through the strainer assemblies 42,44 to strain the coating material. The strained coating material is then operable to be pumped through the supply hoses 118*a,b* connected to each of the boom sections 100,102 and to the boom sections 100,102.

The pump 46 preferably comprises a progressive cavity pump powered by a hydraulic motor 150. The pump 46 has an operating pressure that is preferably greater than about twenty pounds per square inch (20 psi) and preferably less than about fifty pounds per square inch (50 psi). Although the configuration of the illustrated pump 46 is operable to pump material at greater pressures, the spraying assembly 28 of the present invention is efficiently configured to operate even when the pump 46 discharges material at relatively low pressures, preferably less than fifty pounds per square inch (50 psi). While the spraying assembly 28 preferably uses the illustrated progressive cavity pump to pump coating material, it is within the ambit of the present invention where an alternative pump (such as a piston pump) is used. However, the progressive cavity pump has been found to be more durable than other pumps. The pump 46 preferably defines a pump inlet 152 and a pump outlet 154 (see FIG. 12).

The illustrated pump 46 is preferably calibrated to pump a known volume (or mass) of material for one complete pump revolution. Because the control system 144 is programmed to retain the calibrated ratio of pumped material volume (or mass) per revolution of the pump (a single pump revolution is also referred to as a "pump count" or "count"), the processor can calculate the volumetric flow rate (and/or mass flow rate) of material transmitted by the pump 46. Thus, the pump 46 is preferably calibrated so that a range of volumetric flow rates (and/or mass flow rates) of the pump 46 are associated with a corresponding range of pump counts. Preferably, the pump 46 is calibrated so that the error in the actual pump mass flow rate per count produced by the pump 46 (compared to the expected mass flow rate per count) is less than two percent (2%).

The pump 46 is preferably configured to be calibrated without discharging pavement coating material from the spray nozzles 120. Instead, the spraying assembly 28 includes an auxiliary hose (not shown) that is removably fluidly connected relative to the pump 46 so that the pump outlet 46 fluidly communicates with the auxiliary hose. The pump 46 can be operated by the control system 144 to discharge, while operating at a set rotational speed, a volume of material into a container (not shown) for a predetermined number of pump counts. The mass of material in the container is then measured (e.g., by weighing the container and material). The material can then be returned to the tank 26 or another storage container.

This process is preferably repeated several times to discharge and measure the output volumes (mass) of the pump 46. As a result, the calibration process produces a calibration scale factor to be used at any pump rotational speed to calculate the output volume (mass) of pavement coating material.

The suction strainer assembly 42 preferably includes a fluid manifold 156 and two (2) suction strainer baskets 158 (see FIG. 15). However, the suction strainer assembly 42 could include an alternative number of baskets 158. For instance, the suction strainer assembly 42 could include more than two (2) baskets 158. The availability of multiple strainer baskets 158 permits continued operation of the spraying assembly 28 when one of the baskets 158 becomes full of aggregate and congealed coating material (and restricts substantially all material flow through the basket 158). If an alternative suction strainer includes more than two (2) baskets, the spraying assembly could continue to operate if multiple baskets become full of material (provided that at least one basket is not full of material and permits material flow through the basket).

The fluid manifold 156 presents a strainer inlet 160 and strainer outlet 162 of the suction strainer assembly 42 (see FIG. 14). The fluid manifold 156 also presents upstream and downstream chambers 164,166 on opposite sides of the baskets 158 (see FIG. 15).

The fluid manifold 156 includes a diverter 167 that presents the strainer inlet 160 and fluidly communicates with two (2) passages 168 of the manifold 156 (see FIG. 15). Thus, the chambers 164,166 fluidly communicate with each other and with the strainer inlet 160 via the diverter 167. The chambers 164,166 also fluidly communicate with the strainer outlet 162.

The passages 168 preferably extend between the chambers 164,166 in parallel with one another. That is, the passages 168 provide two separate paths for fluid to move between the strainer inlet 160 and the strainer outlet 162.

The suction strainer baskets 158 each preferably include a mesh body 170 and a handle 172 (see FIG. 15). The mesh body 170 includes a side wall 170*a* and a bottom wall 170*b*. The illustrated walls 170*a*,170*b* each comprise a mesh material that presents a plurality of openings. The openings each define an opening size dimension that preferably ranges from about one eighth inch (⅛") to about three eighths of an inch (⅜") and, more preferably, is about one quarter inch (¼"). The walls 170*a*,170*b* cooperatively define a basket chamber 173*a* (see FIG. 12). The baskets 158 each preferably present an open top 173*b* through which the flow of coating material passes into the basket chamber 173*a* (see FIG. 12).

The basket chamber 173*a* of each basket 158 preferably defines a basket volume dimension that ranges from about one gallon to about five gallons. However, for some aspects of the present invention, the basket volume could fall outside of this range.

The suction strainer baskets 158 are removably mounted in the fluid manifold 156 (see FIG. 15). More specifically, each strainer basket 158 is secured in a corresponding one of the passages 168 so that fluid must flow through at least one of the strainer baskets 158 to pass between the chambers 164,166. The fluid manifold 156 includes strainer covers 174 that can be selectively removed to permit the strainer baskets 158 to be accessed and removed from the fluid manifold 156 (e.g., to permit cleaning of the strainer basket 158 and/or the inside of the fluid manifold 156). Each of the illustrated strainer baskets 158 is preferably removable independently of the other strainer basket 158.

The fluid manifold 156 and each strainer basket 158 cooperatively define a manifold axis A1 along which the strainer basket 158 is manually slidable into and out of the passage 168 (see FIGS. 12 and 15). In the illustrated embodiment, the manifold axis A1 is preferably angled upwardly from the lateral direction at an acute angle θ (see FIG. 13) so that an upper margin of the fluid manifold 156 is positioned outboard from a lower margin of the fluid manifold 156. The acute angle θ preferably ranges from about ten degrees (10°) to about fifty degrees (50°) and, more preferably, ranges from about twenty degrees (20°) to about forty degrees (40°). However, for some aspects of the present invention, the acute angle θ could fall outside of this range.

The suction strainer assembly 42 is preferably configured so that an operator can manually lift and remove each of the strainer baskets 158, and any coating material in the baskets 158, from the fluid manifold 156 while standing on the ground alongside the vehicle 20. That is, the operator can lift and remove each strainer basket 158, and any coating material in the basket 158, while standing next to the vehicle 20 without the assistance of powered machinery. As a result, the suction strainer assembly 42 is particularly configured for convenient and quick manual disposal of material caught in the suction strainer assembly 42.

The suction strainer assembly 42 is preferably fluidly connected upstream of the pump 46 so that the strainer outlet 162 fluidly communicates with the pump inlet 152. In particular, the spraying assembly 28 includes a pump intake manifold 176 (see FIG. 15) fluidly connected to the strainer outlet 162 of the suction strainer assembly 42 and to the pump inlet 152.

The suction strainer assembly 42 is also fluidly connected to the tank 26 via a tank discharge valve 177 and a tank discharge line 178 (see FIGS. 13 and 14). The tank discharge line 178 fluidly communicates with the valve 177 and with the fluid manifold 156.

The pump 46 draws coating material from the tank 26 and through the suction strainer assembly 42, with material flowing through at least one of the two suction strainer baskets 158.

The pressure strainer assembly 44 preferably includes a fluid manifold 179 and two (2) pressure strainer baskets 180 (see FIG. 15). However, the pressure strainer assembly 44 could include an alternative number of baskets 180. For instance, the pressure strainer assembly 44 could include more than two (2) baskets 158. The availability of multiple strainer baskets 180 permits continued operation of the spraying assembly 28 when one of the baskets 180 becomes full of aggregate and congealed coating material (and restricts substantially all material flow through the basket 180). If an alternative pressure strainer includes more than two (2) baskets, the spraying assembly could continue to operate if multiple baskets become full of material (provided that at least one basket is not full of material and permits material flow through the basket).

The fluid manifold 179 presents a strainer inlet 182 and a strainer outlet 184 of the pressure strainer assembly 44 (see FIG. 12). The fluid manifold 179 also presents upstream and downstream chambers 186,188 on opposite sides of the baskets 182,184.

The fluid manifold 179 includes a diverter 189 that presents the strainer inlet 182 and fluidly communicates with two (2) passages 190 of the manifold 179 (see FIG. 15). Thus, the chambers 186,188 fluidly communicate with each other and with the strainer inlet 182 via the diverter 189. The chambers 186,188 also fluidly communicate with the strainer outlet 184.

The passages 190 extend between the chambers 186,188 in parallel with one another. That is, the passages 190 provide two separate paths for fluid to move between the strainer inlet 182 and the strainer outlet 184.

The pressure strainer baskets 180 each preferably include a mesh body 192 and a handle 194 (see FIG. 15). The mesh body 192 includes a side wall 192*a* and a bottom wall 192*b*. That walls 192*a*,192*b* each comprise a mesh material that presents a plurality of openings. The openings each define an opening size dimension that preferably ranges from about one eighth inch (⅛") to about three eighths of an inch (⅜") and, more preferably, is about three sixteenths of an inch (3/16"). The walls 192*a*,192*b* cooperatively define a basket chamber 193*a*. The baskets 180 each preferably present an open top 193*b* through which the flow of coating material passes into the basket chamber 193*a*.

The basket chamber 193*a* of each basket 180 preferably defines a basket volume dimension that ranges from about one gallon to about five gallons. However, for some aspects of the present invention, the basket volume could fall outside of this range.

The pressure strainer baskets 180 are removably mounted in the fluid manifold 179. More specifically, each pressure strainer basket 180 is secured in a corresponding one of the passages 168 so that fluid must flow through at least one of the strainer baskets 180 to pass between the chambers 186,188. The fluid manifold 179 includes strainer covers 196 that can be selectively removed to permit the strainer baskets 180 to be accessed and removed from the fluid manifold 179 (e.g., to permit cleaning of the strainer basket 180 and/or the inside of the fluid manifold 179). Each of the illustrated strainer baskets 180 is preferably removable independently of the other strainer basket 180.

The fluid manifold 179 and each strainer basket 180 cooperatively define a manifold axis A2 along which the strainer basket 180 is manually slidable into and out of the passage 190. In the illustrated embodiment, the manifold axis A2 is preferably angled upwardly from the lateral direction at an acute angle (not shown), which is substantially identical to an acute angle θ (see FIG. 13), so that an upper margin of the fluid manifold 179 is positioned outboard from a lower margin of the fluid manifold 179. The acute angle of the manifold axis A2 preferably ranges from about ten degrees (10°) to about fifty degrees (50°) and, more preferably, ranges from about twenty degrees (20°) to about forty degrees (40°). However, for some aspects of the present invention, the acute angle could fall outside of this range.

Also in the illustrated strainer configuration, each pair of axes A1 are generally parallel to each other and each pair of axes A2 are generally parallel to each other. Furthermore, the axes A1 are preferably parallel to the axes A2. However, the strainer assemblies 42,44 could be alternatively configured.

The pressure strainer assembly 44 is preferably configured so that an operator can manually lift and remove each of the strainer baskets 180, and any coating material in the baskets 180, from the fluid manifold 179 while standing on the ground alongside the vehicle 20. That is, the operator can lift and remove each strainer basket 180, and any coating material in the basket 180, while standing next to the vehicle 20 without the assistance of powered machinery. As a result, the pressure strainer assembly 44 is particularly configured for convenient and quick manual disposal of material caught in the pressure strainer assembly 42.

The pressure strainer assembly 44 is preferably fluidly connected downstream of the pump 46 so that the strainer inlet 182 is fluidly connected to the pump outlet 154 with a pump discharge tube 198. Specifically, the pump discharge tube 198 is fluidly connected to the outlet 154 of the pump 46 and the inlet 182 of the pressure strainer assembly 44.

Thus, the pump 46 is operable to pump coating material from the pump outlet 154 through the pressure strainer assembly 44, with material flowing through at least one of the two pressure strainer baskets 158.

While the illustrated spraying assembly 28 includes a single pump 46, it is within the scope of the present invention for the spraying assembly 28 to include multiple pumps. For instance, as disclosed in the above-incorporated ' 'xyz application, an alternative spraying assembly 28 could include a pair of pumps that operate in parallel with one another and cooperatively move material through the strainer assemblies 42,44.

It will be appreciated that one or both of the strainer assemblies 42,44 could be alternatively configured without departing from the scope of the present invention. Furthermore, while the illustrated spraying assembly 28 preferably includes both of the strainer assemblies 42,44, it is within the ambit of the present invention where only one of the strainer assemblies 42,44 is used (e.g., for spraying operation).

Turning to FIG. 14, the outlet 184 of the illustrated pressure strainer assembly 44 fluidly communicates with a tank return inlet 200 and the spray boom 48. In particular, the vehicle 20 preferably includes a pressurized material supply line 202, a supply manifold 204, and boom supply valves 206*a,b*. The line 202 extends rearwardly from the strainer outlet 184 and fluidly communicates with the supply manifold 204. The supply manifold 204 fluidly communicates with the tank return inlet 200 and the boom supply valves 206*a,b*.

The boom supply valves 206*a,b* are configured to selectively permit the flow of pressurized coating material to the boom sections 100,102. Each boom supply valve 206*a,b* comprises a manually operable valve with a fractional turn handle. The boom supply valves 206*a,b* are fluidly connected to corresponding supply hoses 118*a,b* to selectively control the flow of coating material from the supply manifold 204 to corresponding supply hoses 118*a,b*. In particular, the boom supply valve 206*a* is operable when opened to permit the flow of coating material to supply hoses 118*a* and to the chamber 110*a* of the central boom section 100. Boom supply valve 206*b* is operable when opened to control the flow of coating material to supply hoses 118*b* and to the chambers 110*b* of corresponding extendable boom sections 102.

During spraying operation, the boom supply valves 206*a,b* are all preferably opened to permit coating material to flow to all of the boom sections 100,102. However, it is within the scope of the present invention where at least one of the boom supply valves 206*a,b* is closed during operation so that coating material is not supplied to at least one of the boom sections 100,102.

The vehicle 20 is preferably configured to permit convenient and efficient filling of the tank 26 with coating material. Preferably, such filling is generally conducted prior to any spraying operation. The vehicle 20 preferably includes a forward fill assembly 208 and an aft fill assembly 210 (see FIG. 14).

The aft fill assembly 210 preferably includes a stub line 212, a manual fill valve 214, and a coupler end 216 that presents a fill port 218 (see FIG. 14). The stub line 212 is attached to and fluidly communicates with the supply line 202. The fill valve 214 is shiftable between a closed position and an open position (not shown).

The coupler end 216 is configured to be removably attached to a powered material filling station (not shown). The filling station includes a supply tank (not shown), a pump (not shown) that pumps coating material from the supply tank, a fill supply hose (not shown) that discharges pressurized coating material from the pump. The fill supply hose includes a coupler end (not shown) that is coupled to the fill port 218 by removably connecting the coupler end of the fill supply hose to the coupler end 216 of the aft fill assembly 210. With the fill supply hose connected, coating material can be pumped from the supply tank to the supply line 202.

To fill the tank 26 via the aft fill assembly 210, the coupler end of the fill supply hose is initially connected to the coupler end 216. If the boom supply valves 206*a,b* are open, the boom supply valves 206*a,b* are preferably closed prior to operating the filling station. Optionally, the tank discharge valve 177 can also be closed prior to filling the tank 26.

The operator can then operate the pump of the filling station so that coating material flows from the fill supply hose into the supply line 202. The coating material can then travel through the supply manifold 204 and into the tank 26.

The forward fill assembly 208 preferably includes a stub line 220, a manual fill valve 222, and a coupler end 224 that presents a fill port 226 (see FIGS. 12 and 14). The stub line 220 is attached to and fluidly communicates with the pump intake manifold 176. The fill valve 222 is shiftable between a closed position and an open position (not shown).

The coupler end 224 is configured to be removably attached to an unpowered material filling station (not shown). The unpowered filling station includes a supply tank (not shown) and a fill supply hose (not shown) that discharges coating material from the supply tank. However, the unpowered filling station does not include a pump. Rather, the pump 46 is preferably used to draw coating material from the supply tank of the filling station.

The fill supply hose includes a coupler end (not shown) that is coupled to the fill port 226 by removably connecting the coupler end of the fill supply hose to the coupler end 224 of the forward fill assembly 208. With the fill supply hose connected, coating material can be pumped from the supply tank to the pump intake manifold 176.

To fill the tank 26 via the forward fill assembly 208, the coupler end of the fill supply hose is initially connected to the coupler end 224. If the boom supply valves 206*a,b* are open, the boom supply valves 206*a,b* are preferably closed prior to operating the pump 46. Optionally, the tank discharge valve 177 can also be closed prior to filling the tank 26.

The operator can then operate the pump 46 so that coating material flows from the supply tank, through the pump intake manifold 176, and into the pump 46. The coating material can then travel through the pressure strainer assembly 44, the supply line 202, the supply manifold 204, and into the tank 26.

The pump 46 and strainer assemblies 42,44 of spraying assembly 28 are preferably configured to provide recirculation of coating material contained within the tank 26 and other components of the spraying assembly 28. Coating material within the tank 26 is preferably recirculated through the system during a period when coating material is not being sprayed. Recirculation restricts the coating material from becoming clumped and/or from hardening within the system.

To recirculate coating material, the tank discharge valve 177 is preferably opened. If the boom supply valves 206*a,b* are open, the boom supply valves 206*a,b* are preferably closed prior to operating the pump 46. If coating material is being recirculated without pumping additional coating material into the system, the fill valves of the fill assemblies are closed prior to operating the pump 46.

The operator can then operate the pump 46 so that coating material flows from the tank discharge valve 177, through the tank discharge line 178, the suction strainer assembly 42, the pump intake manifold 176, the pump 46, the pressure strainer assembly 44, the supply line 202, the supply manifold 204, and back into the tank 26.

It is also possible to recirculate coating material within the system while also pumping additional coating material into the system. For such an operation, the fill valve 214,222 of the corresponding fill assembly 208,210 used to permit the addition of coating material is opened to permit the introduction of additional coating material.

Control System

Turning to FIGS. 17 and 18, the spraying assembly 28 preferably includes the control system 144 to open and close valves 122 of the central boom section 100 and the extendable boom section 102. The control system 144 is also used to set and maintain a predetermined application rate of pavement coating material applied to a roadway. The control system 144 preferably includes a processor element 228, a memory element 230, a user interface 232, a ground speed sensor 234, and a rotation speed sensor 236.

The control system 144 preferably includes hydraulic valves (not shown) that are operably coupled to, respectively, the boom shift cylinder 56, lift cylinder 90, boom extension cylinders 136, and valve cylinders 124. Thus, the control system 144 is configured to control the piston position for each of the cylinders 56,90,124,136.

As discussed above, the illustrated pump 46 is preferably calibrated to pump a known mass or volume of material per pump count. The pump 46 can be operated by the control system 144 to discharge, while operating at a set rotational speed, a volume of material into a container (not shown) for a predetermined number of pump counts. The mass of material in the container is then measured (e.g., by weighing the container and material) to produce a calibration scale factor. The calibration scale factor is stored in the control system 144 and later used by the control system 144 during operation to correlate pump count with the output volume (mass) of pavement coating material.

The ground speed sensor 234 is attached to the chassis frame 30 to sense the ground travel speed of the vehicle 20. The sensor 234 preferably comprises a radar sensor, although other vehicle speed sensors could be used without departing from the scope of the present invention.

The rotation speed sensor 236 is operably coupled to the pump 46 and is configured to sense the rotational speed of the pump 46. The illustrated pump 46 is preferably calibrated to pump a known volume of material for one complete pump revolution. Because the control system 144 is programmed to retain calibration data ratios of pumped material volume per revolution of the pump, the processor can calculate the volumetric flow rate (and/or mass flow rate) of material transmitted by the pump 46 as a function of the pump rotational speed.

The processor element 228 is operably coupled to the sensors 234,236 to receive signals from the sensors corresponding to the sensed speed values. The processor element 228 is also preferably coupled to other sensors associated with the spraying system 28, and other components of the vehicle 20, to receive signals from those sensors about various operational parameters.

The user interface 232 is configured for an operator to input various predetermined operating parameters associated with a particular spraying operation. In the illustrated embodiment, the user interface 232 preferably permits the operator to input the predetermined application rate of pavement coating material applied to the roadway. The user interface 232 also preferably permits the operator to input a predetermined value of boom width B.

The illustrated user interface 232 is preferably installed in the cab 24 and is accessible by the vehicle operator (e.g., when advancing the vehicle 20). However, the vehicle 20 also includes another user interface that is similar to the user interface 232 and is mounted on the rear deck 38 of the vehicle 20.

Based upon the predetermined value of boom width B, the control system 144 is preferably programmed to move the extendable boom sections 100,102 to corresponding positions so that the spray boom 48 provides the corresponding boom width dimension. Additionally, the control system 144 is also preferably programmed to keep corresponding valves 122 open so that corresponding spray nozzles 120 are engaged and operable to spray across the boom width B.

Preferably, the processor element 228 is operably coupled to the pump 46 to control the rotational speed of the pump 46. The processor element 228 calculates a pump rotation speed setpoint value as a function of the user inputted values of predetermined application rate and boom width B. The processor element 228 also calculates the pump rotation speed setpoint value as a function of the sensed value of ground speed from the ground speed sensor 234. As the operator increases or decreases the ground speed of the vehicle 20, the processor element 228 automatically adjusts the rotational speed of the pump 46 to automatically maintain the predetermined application rate of pavement coating material.

In use, prior to engaging the spraying assembly 28, the vehicle operator preferably sets the predetermined application rate of pavement coating material to be achieved by spraying a flow of pavement coating material onto the roadway. Also prior to engaging the spraying assembly 28, the operator preferably sets the boom width B. If the spray boom 48 is not at the boom width B, the spray boom 48 can be adjusted automatically by the control system 144 or manually by the operator. The operator can then engage the spraying assembly 28 and begin advancing the vehicle 20 forwardly along the roadway.

As the vehicle 20 is being advanced, the control system 144 preferably determines the ground speed of the vehicle 20. In particular, the processor element 228 receives a ground speed signal from the ground speed sensor 234.

Also, as the vehicle 20 is being advanced, the control system 144 supplies power to and operates the pump 46 to discharge the flow of pavement coating material onto the roadway through the engaged spray nozzles 120 (i.e., the spray nozzles 120 associated with valves 122 that are kept open by the control system 144).

The pump 46 is preferably operated to maintain the predetermined application rate by adjusting the volumetric flow rate (or mass flow rate) of the pump 46 in response to a change in the sensed ground speed.

If the operator adjusts the boom width B during the spraying operation, the control system 144 preferably automatically adjusts the volumetric flow rate (or mass flow rate) of the pump 46 to maintain the predetermined application rate of coating material.

Although the above description presents features of preferred embodiments of the present invention, other preferred embodiments may also be created in keeping with the principles of the invention. Such other preferred embodiments may, for instance, be provided with features drawn from one or more of the embodiments described above. Yet further, such other preferred embodiments may include features from multiple embodiments described above, particularly where such features are compatible for use together despite having been presented independently as part of separate embodiments in the above description.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A coating applicator vehicle configured to selectively discharge a flowable pavement coating material onto a roadway, said coating applicator vehicle comprising:

a rolling chassis operable to be advanced in a forward direction along the roadway; and a spray bar assembly supported by the rolling chassis and extending transversely to the forward direction to selectively discharge coating material along a lateral direction, said spray bar assembly including a shiftable spray boom, spray nozzles, and a frame mounted relative to the chassis, said spray boom presenting an elongated chamber to receive and carry the coating material laterally, said spray nozzles fluidly communicating with the chamber to receive a flow of the coating material from the spray boom and discharge the coating material, said spray boom being shiftably supported by the frame to move laterally relative to the rolling chassis, said frame supporting the spray boom relative to the rolling chassis and permitting the spray boom to shift vertically relative to the rolling chassis, said spray bar assembly including a spray bar link that shiftably interconnects the rolling chassis and the frame and permits the frame to move vertically relative to the rolling chassis.

2. The coating applicator vehicle as claimed in claim 1, said frame including slider brackets shiftably mounted relative to rolling chassis, said frame further including a slider housing attached to the spray boom, said slider housing being slidably attached relative to the slider brackets to permit lateral sliding movement of the spray boom relative to the rolling chassis.

3. The coating applicator vehicle as claimed in claim 1; and a lateral shift motor mounted on the frame and attached relative to the spray boom to move the spray boom laterally relative to the rolling chassis.

4. The coating applicator vehicle as claimed in claim 3, said lateral shift motor comprising a hydraulic cylinder.

5. The coating applicator vehicle as claimed in claim 1, said shiftable spray boom including a plurality of boom sections that present respective elongated chambers to receive and carry the coating material laterally, with the chambers including the first-mentioned chamber.

6. The coating applicator vehicle as claimed in claim 5, said spray nozzles supported outside of the chambers, each of said boom sections supporting and operable to fluidly communicate with at least one of the spray nozzles.

7. The coating applicator vehicle as claimed in claim 6, said boom sections being shiftably attached to one another, with the boom sections extending along a common lateral direction.

8. The coating applicator vehicle as claimed in claim 7, said boom sections being slidably attached to one another and slidable relative to each other along the common lateral direction.

9. The coating applicator vehicle as claimed in claim 8, said boom sections including a central boom section that presents opposite lateral ends and opposite extendable boom sections slidably attached relative to the central boom section, said boom sections shiftable between a retracted position, where the extendable boom sections overlap at least partly with the central boom section to cooperatively define a minimum boom width dimension, and a deployed position where the extendable boom sections are shifted in opposite outboard directions to project laterally outboard from the lateral ends and to cooperatively define a boom width dimension greater than the minimum boom width dimension.

10. The coating applicator vehicle as claimed in claim 9, said extendable boom sections located forwardly of the central boom section, said spray nozzles in fluid communication with the extendable boom sections located forwardly of the extendable boom sections, said spray nozzles in fluid communication with the central boom section located rearwardly of the central boom section.

11. The coating applicator vehicle as claimed in claim 1, said spray bar assembly including a plurality of spray bar links that are generally parallel to one another and cooperate with the frame and the rolling chassis to form a four-bar linkage that permits the frame to move vertically relative to the rolling chassis.

12. The coating applicator vehicle as claimed in claim claim 1, said spray bar assembly including a vertical shift motor mounted to the rolling chassis and attached relative to the frame, said vertical shift motor being operable to shift the frame and the spray boom vertically relative to the rolling chassis.

13. The coating applicator vehicle as claimed in claim 12, said vertical shift motor comprising a hydraulic cylinder.

14. The coating applicator vehicle as claimed in claim 1, said spray bar assembly including the spray nozzles and a valve supported by the spray boom, said valve being located between and selectively fluidly interconnecting the chamber and at least one of the spray nozzles to control the flow of coating material through the at least one spray nozzle.

15. The coating applicator vehicle as claimed in claim 14, said spray bar assembly including a plurality of valves spaced along the length of and supported by the spray boom, with the valves including the first-mentioned valve, each of said valves selectively fluidly interconnecting the chamber and a corresponding one of the spray nozzles to control the flow of coating material through the one spray nozzle.

16. The coating applicator vehicle as claimed in claim 15, each of said valves being located outside the chamber, said spray bar assembly including a valve motor supported by the boom and drivingly connected relative to the valves to selectively open and/or close the valves.

17. The coating applicator vehicle as claimed in claim 16, said spray bar assembly including a valve linkage that drivingly connects the motor to a plurality of the valves to simultaneously shift the plurality of valves.

18. The coating applicator vehicle as claimed in claim 16, said valve motor comprising a hydraulic cylinder.

19. The coating applicator vehicle as claimed in claim 15, each of said valves comprising a ball valve.

20. The coating applicator vehicle as claimed in claim 1, said shiftable spray boom including a plurality of boom sections that present respective elongated chambers to receive and carry the coating material laterally, with the spray boom presenting a lateral boom width, said spray nozzles cooperatively discharging coating material in a lateral application spray pattern associated with the boom width, said frame including a slider bracket mounted relative to the rolling chassis, said frame further including a slider housing slidably attached relative to each of the boom sections and permitting each boom section to slide relative thereto along the lateral direction to change the boom width and thereby change the size of the spray pattern, said slider housing being slidably attached relative to the slider bracket to permit the slider housing and boom sections to slide with one another relative to the slider bracket and the rolling chassis along the lateral direction and thereby shift the spray pattern laterally relative to the chassis.

21. A spray bar assembly operable to be mounted on and advanced in a longitudinal travel direction with a vehicle to discharge flowable pavement coating material onto a roadway, where the material includes a liquid emulsion and aggregate, said spray bar assembly comprising:

a shiftable spray boom presenting an elongated chamber to receive and carry the coating material laterally; and a plurality of spray nozzles fluidly communicating with the chamber to receive a flow of coating material from the spray boom and to discharge the flow of coating material, said spray nozzles being mounted relative to the spray boom and aligned longitudinally with each other to cooperatively define a lateral line of nozzles that extends along the length of the spray boom, with each pair of adjacent spray nozzles being separated by a spacing dimension, each of said spray nozzles discharging the coating material in a generally planar fan pattern that impinges the roadway along a laterally extending spray line, said line defining a maximum fan width dimension greater than the spacing dimension, said spray nozzles being positioned so that the spray line associated with each spray nozzle extends at an acute angle relative to the lateral line, with the fan patterns of adjacent spray nozzles laterally overlapping one another without intersecting.

22. The spray bar assembly as claimed in claim 21, said spray nozzles being positioned so that the spray lines are generally parallel to one another.

23. The spray bar assembly as claimed in claim 22, said lateral line of spray nozzles being generally perpendicular to the travel direction.

24. The spray bar assembly as claimed in claim 22, said spray line defining a maximum fan width dimension that ranges from about two feet to about four feet.

25. The spray bar assembly as claimed in claim 21; and a valve supported by the spray boom, said valve being located between and selectively fluidly interconnecting the chamber and at least one of the spray nozzles to control the flow of coating material through the at least one spray nozzle.

26. The spray bar assembly as claimed in claim 25; and a plurality of valves spaced along the length of and supported by the spray boom, with the valves including the first-mentioned valve, each of said valves selectively fluidly interconnecting the chamber and a corresponding one of the spray nozzles to control the flow of coating material through the one spray nozzle.

27. The spray bar assembly as claimed in claim 26, each of said valves being located outside the chamber; and a valve motor supported by the boom and drivingly connected relative to the valves to selectively open and/or close the valves.

28. The spray bar assembly as claimed in claim 27; and a valve linkage that drivingly connects the motor to each of the valves to simultaneously shift the valves.

29. The spray bar assembly as claimed in claim 27, said valve motor comprising a hydraulic cylinder.

30. The spray bar assembly as claimed in claim 26, each of said valves comprising a ball valve.

31. The spray bar assembly as claimed in claim 21, said shiftable spray boom including a plurality of boom sections that present respective elongated chambers to receive and carry the coating material laterally, with the chambers including the first-mentioned chamber.

32. The spray bar assembly as claimed in claim 31, said spray nozzles supported outside of the chambers, with the spray nozzles including the first-mentioned spray nozzle, each of said boom sections supporting and operable to fluidly communicate with a corresponding series of the spray nozzles.

33. The spray bar assembly as claimed in claim 32, said boom sections being shiftably attached to one another, with the boom sections extending along a common lateral direction.

34. The spray bar assembly as claimed in claim 33, said boom sections being slidably attached to one another and slidable relative to each other along the common lateral direction.

35. The spray bar assembly as claimed in claim 34, said boom sections including a central boom section that presents opposite lateral ends and opposite extendable boom sections slidably attached relative to the central boom section, said boom sections shiftable between a retracted position, where the extendable boom sections overlap at least partly with the central boom section to cooperatively define a minimum boom width dimension, and a deployed position where the extendable boom sections are shifted in opposite outboard directions to project laterally outboard from the lateral ends and to cooperatively define a boom width dimension greater than the minimum boom width dimension.

36. The spray bar assembly as claimed in claim 35, said extendable boom sections located forwardly of the central boom section, said spray nozzles in fluid communication with the extendable boom sections located forwardly of the extendable boom sections, said spray nozzles in fluid communication with the central boom section located rearwardly of the central boom section.

37. The spray bar assembly as claimed in claim 32; and a plurality of valves spaced along the length of and supported by the spray boom, with the valves including the first-mentioned valve, each of said valves selectively fluidly interconnecting a corresponding one of the chambers and a corresponding one of the spray nozzles to control a respective flow of coating material therebetween.

38. The spray bar assembly as claimed in claim 37, each of said boom sections supporting and operable to fluidly communicate with a corresponding series of the valves.

39. The spray bar assembly as claimed in claim 38; and valve motors, each of said valve motors supported by a corresponding one of the boom sections and drivingly connected relative to valves associated the corresponding boom section to selectively open and/or close the associated valves, each of said valve motors configured to shift the associated valves independently of the other valves.

40. The spray bar assembly as claimed in claim 39; and valve linkages, each of said valve linkages supported by a corresponding one of the boom sections and drivingly connecting the corresponding valve motor to each of the associated valves to simultaneously shift the associated valves.

* * * * *